US010144599B2

(12) United States Patent
Wakabayashi et al.

(10) Patent No.: US 10,144,599 B2
(45) Date of Patent: Dec. 4, 2018

(54) SHEET FEEDING DEVICE AND IMAGE FORMING APPARATUS INCORPORATING THE SHEET FEEDING DEVICE

(71) Applicants: Yu Wakabayashi, Kanagawa (JP); Kaoru Shoji, Kanagawa (JP); Masashi Sato, Kanagawa (JP); Shohei Shinkawa, Tokyo (JP); Tetsutaro Oishi, Kanagawa (JP); Rie Ohtsuka, Tokyo (JP)

(72) Inventors: Yu Wakabayashi, Kanagawa (JP); Kaoru Shoji, Kanagawa (JP); Masashi Sato, Kanagawa (JP); Shohei Shinkawa, Tokyo (JP); Tetsutaro Oishi, Kanagawa (JP); Rie Ohtsuka, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/386,850

(22) Filed: Dec. 21, 2016

(65) Prior Publication Data

US 2017/0185025 A1 Jun. 29, 2017

(30) Foreign Application Priority Data

Dec. 24, 2015 (JP) ..... 2015-252625

(51) Int. Cl.
*B65H 1/14* (2006.01)
*B65H 3/06* (2006.01)
(Continued)

(52) U.S. Cl.
CPC ..... *B65H 1/14* (2013.01); *B65H 1/04* (2013.01); *B65H 1/26* (2013.01); *B65H 1/28* (2013.01);
(Continued)

(58) Field of Classification Search
CPC ... B65H 1/04; B65H 1/14; B65H 1/26; B65H 1/28; B65H 3/06; B65H 3/66;
(Continued)

(56) References Cited

U.S. PATENT DOCUMENTS 3,957,366 A * 5/1976 Taylor ..... B65H 1/04 271/110
8,985,571 B2 * 3/2015 Ueda ..... B65H 1/04 271/171
(Continued)

FOREIGN PATENT DOCUMENTS

JP 1-156265 6/1989
JP 4-361938 12/1992
(Continued)

*Primary Examiner* — David H Bollinger
(74) *Attorney, Agent, or Firm* — Harness, Dickey & Pierce, P.L.C.

(57) ABSTRACT

A sheet feeding device, which is included in an image forming apparatus, includes a sheet container to accommodate a recording medium, a sheet feeding body to press a surface of the recording medium in the sheet container and feed the recording medium in a sheet conveying direction, a pair of sheet position regulators to regulate a position of the recording medium in a sheet width direction perpendicular to the sheet conveying direction, and a load applier to contact the surface of the recording medium and apply a load to the recording medium at the surface. The recording medium is brought to move toward one of the pair of sheet position regulators while the recording medium is being fed. A lower face position in a standby state of the sheet feeding body is lower than a lower face position in a standby state of the load applier.

19 Claims, 20 Drawing Sheets

(51) Int. Cl.

| | |
|---|---|
| ***B65H 3/66*** | (2006.01) |
| ***B65H 1/26*** | (2006.01) |
| ***B65H 1/28*** | (2006.01) |
| ***B65H 1/04*** | (2006.01) |
| ***B65H 9/10*** | (2006.01) |
| ***B65H 9/16*** | (2006.01) |
| ***G03G 15/00*** | (2006.01) |

(52) U.S. Cl.
CPC ..... *B65H 3/06* (2013.01); *B65H 3/66* (2013.01); *B65H 9/101* (2013.01); *B65H 9/166* (2013.01); *G03G 15/6511* (2013.01); *G03G 15/6564* (2013.01); *G03G 15/6567* (2013.01); *B65H 2405/1142* (2013.01); *B65H 2405/11425* (2013.01); *B65H 2405/311* (2013.01); *B65H 2405/331* (2013.01); *B65H 2801/06* (2013.01); *G03G 2215/00396* (2013.01)

(58) Field of Classification Search
CPC ..... B65H 9/101; B65H 9/103; B65H 9/166; B65H 2405/1142; B65H 2405/11425; B65H 2405/331; B65H 2405/311
USPC ..... 271/241, 157, 171
See application file for complete search history.

(56) References Cited

U.S. PATENT DOCUMENTS

| | | | | |
|---|---|---|---|---|
| 2009/0200728 | A1* | 8/2009 | Sugiyama | B65H 1/266 271/9.01 |
| 2010/0133741 | A1 | 6/2010 | Sato | |
| 2010/0133743 | A1* | 6/2010 | Hamasaki | B65H 1/04 271/241 |
| 2013/0168210 | A1 | 7/2013 | Yamazaki et al. | |
| 2013/0250328 | A1 | 9/2013 | Ohtsuka et al. | |
| 2016/0355355 | A1* | 12/2016 | Hirajima | B65H 1/18 |
| 2017/0001819 | A1* | 1/2017 | Shiba | B65H 5/068 |

FOREIGN PATENT DOCUMENTS

| | | |
|---|---|---|
| JP | 6-040606 | 2/1994 |
| JP | 7-081799 | 3/1995 |
| JP | 7-206224 | 8/1995 |
| JP | 2004-345848 | 12/2004 |
| JP | 2006-347732 | 12/2006 |
| JP | 2013-056713 | 3/2013 |
| JP | 2013-193862 | 9/2013 |
| JP | 2013-241253 | 12/2013 |
| JP | 2014-005145 | 1/2014 |
| JP | 2014-054808 | 3/2014 |
| JP | 2015-071496 | 4/2015 |
| JP | 2015-087470 | 5/2015 |
| JP | 2015-174285 | 10/2015 |

* cited by examiner

SHEET FEEDING DEVICE AND IMAGE FORMING APPARATUS INCORPORATING THE SHEET FEEDING DEVICE

CROSS-REFERENCE TO RELATED APPLICATION

This patent application is based on and claims priority pursuant to 35 U.S.C. § 119(a) to Japanese Patent Application No. 2015-252625, filed on Dec. 24, 2015, in the Japan Patent Office, the entire disclosure of which is hereby incorporated by reference herein.

BACKGROUND

Technical Field

This disclosure relates to a sheet feeding device and an image forming apparatus incorporating the sheet feeding device.

Related Art

Various types of electrophotographic image forming apparatus are known to include a sheet feeding device to feed a sheet one by one from a sheet container that accommodates multiple sheets therein to an image forming apparatus or to an image forming device.

For example, such a sheet feeding device includes a load applying member disposed between a sheet regulating member and a sheet conveying member in a sheet width direction of a sheet container. The load applying member is pressed against a surface of a sheet that functions as a recording medium to apply a predetermined load to the sheet.

When the sheet is conveyed, the load applying member applies a load such that a moment of rotation exerted by the sheet conveying member to the sheet and a moment of rotation exerted by the load applying member to the sheet are evenly balanced. According to this configuration, the skew of the sheet conveyed from the sheet container is reduced.

For example, conveying forces of the sheet conveying member become uneven affected by installation environment of the sheet conveying device and the image forming apparatus. At that time, the degree of the moment of rotation exerted by the sheet conveying member to the sheet changes. Consequently, the moment of rotation that is exerted by the sheet conveying member to be applied to the sheet and the moment of rotation that is exerted by the load member to be applied to the sheet may not be proportional, in other words, become imbalance. As a result, the skew of the sheet conveyed from the sheet container occurs.

SUMMARY

At least one aspect of this disclosure provides a sheet feeding device including a sheet container, a sheet feeding body, a pair of sheet position regulators, and a load applier. The sheet container accommodates a recording medium. The sheet feeding body presses a surface of the recording medium in the sheet container and feed the recording medium in a sheet conveying direction. The pair of sheet position regulators includes a first sheet position regulator and a second sheet position regulator disposed facing each other across the recording medium in the sheet container in a sheet width direction perpendicular to the sheet conveying direction. The pair of sheet position regulators regulates a position of the recording medium in the sheet width direction. The load applier is disposed between the first sheet position regulator and the sheet feeding body in the sheet width direction. The load applier contacts the surface of the recording medium and apply a load to the recording medium at the surface. The recording medium is brought to move toward the second sheet position regulator while the recording medium is being fed.

Further, at least one aspect of this disclosure provides an image forming apparatus including an image forming device to form an image on a recording medium, and the above-described sheet feeding device to feed recording medium contained in the sheet container toward the image forming device.

Further, at least one aspect of this disclosure provides a sheet feeding device including a sheet container, a sheet feeding body, a pair of sheet position regulators, and a load applier. The sheet container accommodates a recording medium. The sheet feeding body presses a surface of the recording medium in the sheet container and feed the recording medium in a sheet conveying direction. The pair of sheet position regulators includes a first sheet position regulator and a second sheet position regulator disposed facing each other across the recording medium in the sheet container in a sheet width direction perpendicular to the sheet conveying direction. The pair of sheet position regulators regulates a position of the recording medium in the sheet width direction. The load applier is disposed between the first sheet position regulator and the sheet feeding body in the sheet width direction. The load applier contacts the surface of the recording medium and apply a load to the recording medium at the surface. A lower face position in a standby state of the sheet feeding body is lower than a lower face position in a standby state of the load applier.

Further, at least one aspect of this disclosure provides an image forming apparatus including an image forming device to form an image on a recording medium, and the above-described sheet feeding device to feed recording medium contained in the sheet container toward the image forming device.

DETAILED DESCRIPTION

Figure 1:
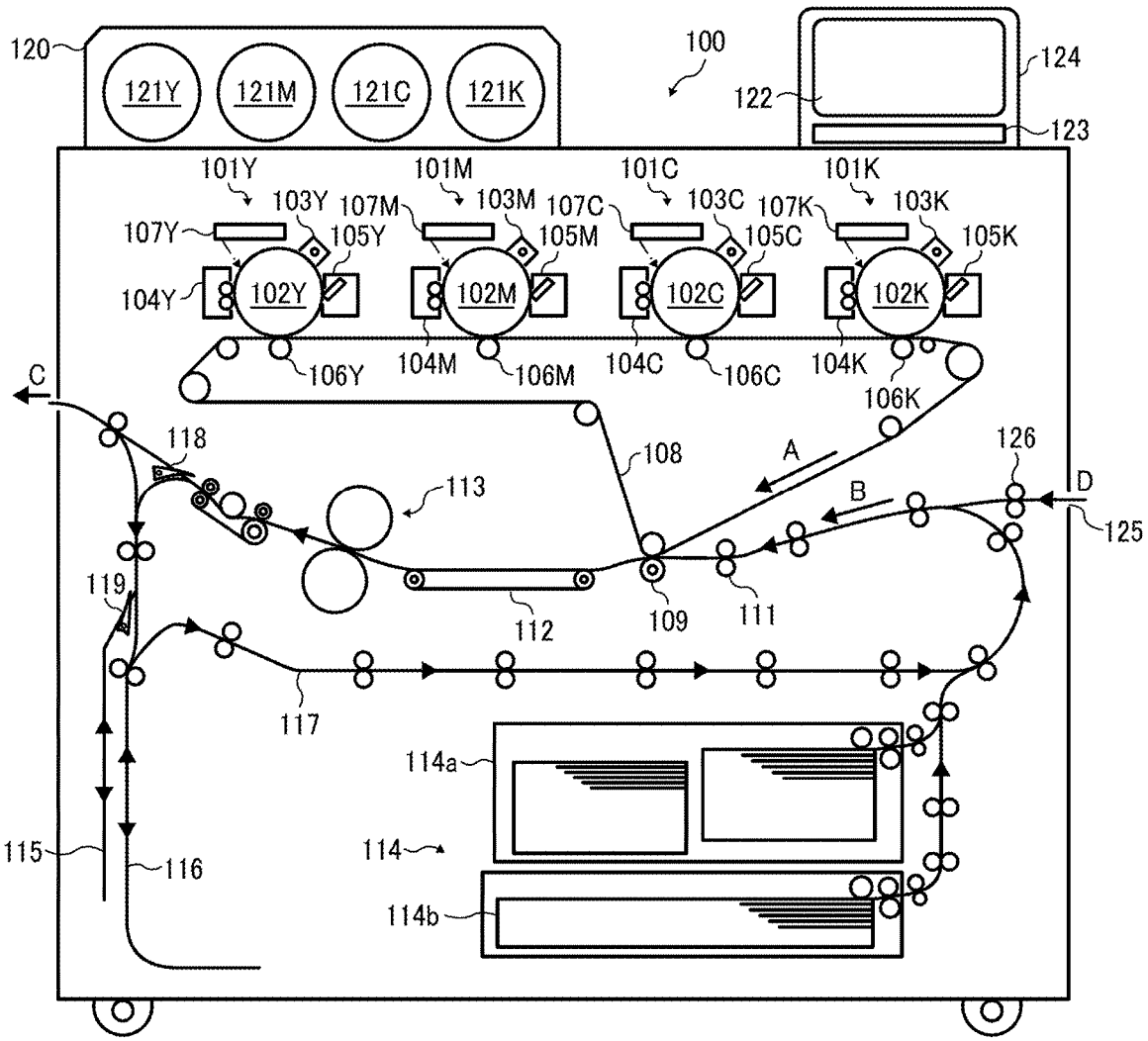
FIG. 1 is a diagram illustrating a schematic configuration of the image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Embodiment 1

A description is given of an image forming apparatus 100 according to an embodiment of this disclosure, configured to form an image on a recording medium that functions as a sheet.

FIG. 1 is a schematic diagram illustrating the image forming apparatus 100 according to the present embodiment of this disclosure.

It is to be noted that identical parts are given identical reference numerals and redundant descriptions are summarized or omitted accordingly.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

Now, a description is given of an entire configuration and functions of the image forming apparatus 100 according to an embodiment of this disclosure.

As illustrated in FIG. 1, the image forming apparatus 100 has printing and copying functions for forming a full color image with four color toners such as yellow (Y), cyan (C), magenta (M), and black (K).

As illustrated in FIG. 1, the image forming apparatus 100 includes four image forming units 101Y, 101M, 101C, and 101K. The image forming units 101Y, 101M, 101C, and 101K that form respective single color images are aligned at an upper part of an apparatus body of the image forming apparatus 100. The image forming units 101Y, 101M, 101C, and 101K have a substantially identical configuration and functions to each other. Therefore, following details of the image forming units 101Y, 101M, 101C, and 101K are described with a single image forming unit that corresponds to each of the image forming units 101Y, 101M, 101C, and 101K, without the suffixes Y, M, C, and K indicating respective colors. The image forming unit 101 (i.e., the image forming units 101Y, 101M, 101C, and 101K) includes a photoconductor drum 102 (i.e., photoconductor drums 102Y, 102M, 102C, and 102K), a charger 103 (i.e., chargers 103Y, 103M, 103C, and 103K), and a cleaning device 105 (i.e., cleaning devices 105Y, 105M, 105C, and 105K). The charger 103, the developing device 104, and the cleaning device 105 are disposed around the photoconductor drum 102.

Further, an exposure device 107 is disposed above the photoconductor drum 102.

An intermediate transfer belt 108 is disposed below the image forming units 101Y, 101M, 101C, and 101K. The intermediate transfer belt 108 is wound around multiple support rollers.

As one of the multiple support rollers is driven by a drive unit, the intermediate transfer belt 108 is rotated in a direction indicated by arrow A in FIG. 1.

A transfer roller 106 (i.e., transfer rollers 106Y, 106M, 106C, and 106K) that functions as a primary transfer unit is disposed facing the photoconductor drum 102 of the image forming unit 101 with the intermediate transfer belt 108 interposed therebetween. When the transfer roller 106 and the photoconductor drum 102 contact with the intermediate transfer belt 108 interposed therebetween, a primary transfer portion is formed to primarily transfer the toner image onto the photoconductor drum 102.

In the image forming unit 101, the photoconductor drum 102 is rotated in a counterclockwise direction in FIG. 1. Then, the charger 103 uniformly charges a surface of the photoconductor drum 102 to a predetermined polarity. Then, an optically modulated laser light beam is emitted from the exposure device 107, so that an electrostatic latent image is formed on the charged surface of the photoconductor drum 102. The electrostatic latent image is developed with toner applied by the developing device 104 into a visible toner image. The visible toner images of respective single colors formed by the image forming units 101Y, 101M, 101C, and 101K are sequentially transferred in layers onto a surface of the intermediate transfer belt 108.

By contrast, a sheet feeding device 114 is disposed below the apparatus body of the image forming apparatus 100. The sheet feeding device 114 includes a tandem sheet tray 114*a* and a sheet tray 114*b* and feeds out a sheet. The fed sheet is conveyed to a pair of registration rollers 111 in a direction indicated by arrow B in FIG. 1.

The sheet contacted and temporarily stopped at the pair of registration rollers 111 is fed out from the pair of registration rollers 111 in synchronization with movement of the toner image formed on the surface of the intermediate transfer belt 108. Then, the sheet is conveyed to a secondary transfer portion where a secondary transfer roller 109 contacts the intermediate transfer belt 108. A voltage having an opposite polarity to a toner charge polarity is applied to the secondary transfer roller 109. By so doing, the composite toner image (the full color image) formed on the surface of the intermediate transfer belt 108 is transferred onto the sheet.

After the toner image has been transferred thereto, the sheet is conveyed by a sheet conveying belt 112 to a fixing device 113. In the fixing device 113, the toner image is fixed to the sheet by application of heat and pressure.

After the toner image is fixed thereto, the sheet is ejected out of the apparatus body of the image forming apparatus 100 as indicated by arrow C in FIG. 1 onto a sheet ejection tray.

It is to be noted that, when the sheet is ejected with the back of the sheet facing up in the single-side printing (a face down ejection), the sides of the sheet are reversed by ejecting the sheet outside the apparatus body of the image forming apparatus 100 as indicated by arrow C in FIG. 1 via a sheet reverse portion 115.

Further, in the duplex printing, the sheet after the toner image has been fixed thereto is conveyed via a duplex reverse portion 116 from a reentry path 117 to the pair of registration rollers 111 again. By so doing, a toner image formed on the surface of the intermediate transfer belt 108 is transferred onto the back of the sheet.

After the toner image has been transferred onto the sheet, the toner image is fixed to the sheet in the fixing device 113. Then, similar to the single-side printing, the sheet is ejected out in the direction C in FIG. 1 directly from the fixing device 115 or via the sheet reverse portion 115. In addition, switching claws 118 and 119 are disposed appropriately to switch a sheet feeding direction.

In a case of a monochrome printing, the image forming apparatus 100 according to the present embodiment uses the image forming unit 101K to form a monochrome toner image and transfers the monochrome toner image onto a sheet via the intermediate transfer belt 108. A sheet having a monochrome toner image thereon is handled along the same process as a sheet having a full color toner image after the toner image is fixed to the sheet.

It is to be noted that the image forming apparatus 100 further includes a toner bottle set 120 on an upper face of the apparatus body. The toner bottle set 120 sets respective color toner bottles 121 (i.e., toner bottles 121Y, 121M, 121C, and 121K) that contains toner to be supplied to the developing device 104 of the image forming unit 101.

Further, the image forming apparatus 100 further includes an operation unit 124 that includes a display 122 and a control panel 123.

In addition, the image forming apparatus 100 further includes a bypass tray opening 125 and a pair of bypass rollers 126. A sheet loaded on a bypass tray is guided into the apparatus body of the image forming apparatus 100 through the bypass tray opening 125 in a direction indicated by arrow D and fed by the pair of bypass rollers 126 toward the pair of registration rollers 111.

Figure 2:
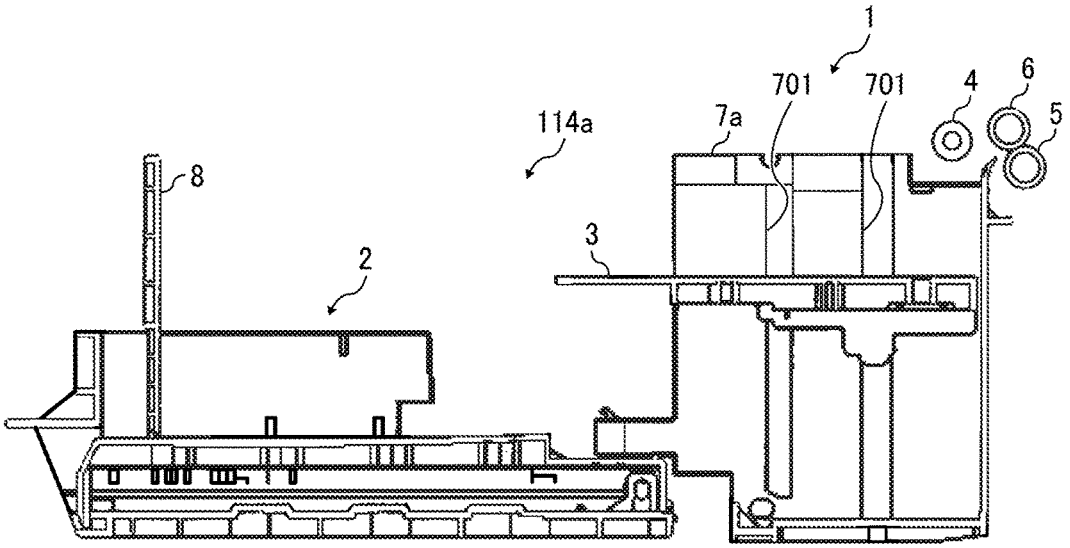
FIG. 2 is a cross sectional view illustrating a tandem sheet tray.

FIG. 2 is a cross sectional view illustrating the tandem sheet tray 114*a*.

As illustrated in FIG. 2, the tandem sheet tray 114*a* includes a sheet feed tray 1 that functions as a first sheet container and a sheet supply tray 2 that functions as a second sheet container.

The sheet feed tray 1 includes a bottom plate 3 that can be lifted and lowered. The sheet feed tray 1 further includes a sheet pickup roller 4 that functions as a sheet feeding unit, a sheet reverse roller 5, and a sheet feed roller 6. The sheet pickup roller 4 closely contacts an uppermost sheet placed on top of the bundle of sheets loaded on the bottom plate 3, and feeds the sheet toward a sheet separation nip region where the sheet feed roller 6 and the sheet reverse roller 5 contact each other. The sheet fed toward the sheet separation nip region is separated from the sheet feed roller 6 and the sheet reverse roller 5. Then, the uppermost sheet is conveyed toward the pair of registration rollers 111.

Further, the sheet feed tray 1 is mounted with a pair of side fences 7*a* and 7*b* to regulate a position in a sheet width position of the bundle of sheets on the bottom plate 3. Each two supports are disposed projecting in the sheet width direction from both ends of the bottom plate 3 in the sheet width direction. The supports go through respective guide openings 701. Each two guide openings 701 extend in a vertical direction and are provided to each of the pair of side fences 7*a* and 7*b*.

The sheet supply tray 2 that functions as a second sheet container is disposed substantially horizontal along with the sheet feed tray 1. The sheet supply tray 2 is also removably inserted to the apparatus body of the image forming apparatus 100 in a direction substantially perpendicular to the sheet feeding direction. The sheet supply tray 2 includes a sheet transfer fence 8 to shift the bundle of sheets loaded on the sheet supply tray 2 altogether to the sheet feed tray 1.

Figure 3:
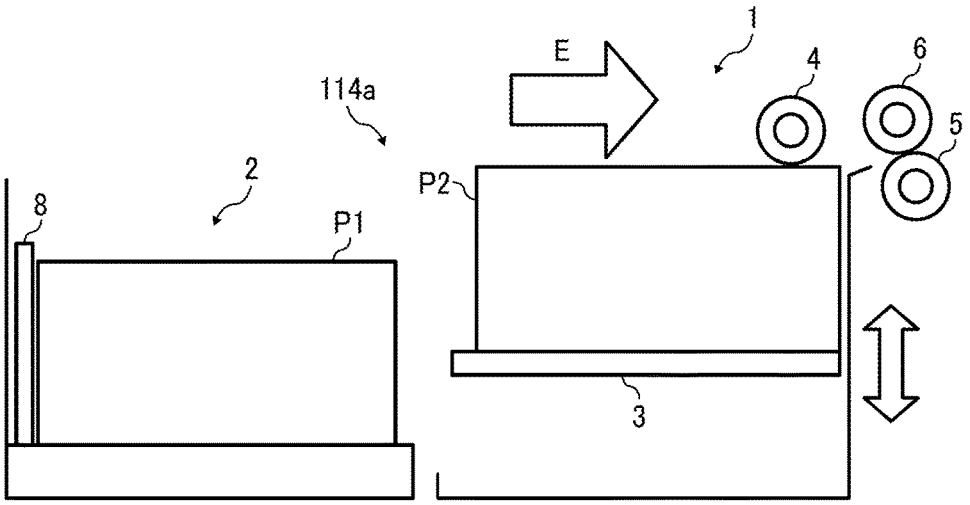
FIG. 3 is a diagram illustrating a sheet feeding condition of the tandem sheet tray of FIG. 2.

FIG. 3 is a diagram illustrating a sheet feeding state of the tandem sheet tray 114*a* of FIG. 2.

As illustrated in FIG. 3, the sheet feed tray 1 accommodates a sheet bundle P2 and the sheet supply tray 2 accommodates a sheet bundle P1. In the present embodiment, the sheet feed tray 1 and the sheet supply tray 2 can contain approximately 500 sheets such as A4-size sheets, respectively. It is to be noted that, if the tandem sheet tray 114*a* has a larger capacity, the sheet feed tray 1 can accommodate approximately 1250 sheets.

In the above-described sheet feeding state, the sheet transfer fence 8 is located at a home position. As a loader elevation device lifts the bottom plate 3, the sheet pickup roller 4 is brought to contact and press an uppermost sheet placed on top of the sheet bundle P2 loaded on the bottom plate 3. By driving the sheet pickup roller 4, the uppermost sheet of the sheet bundle P2 is fed in the direction indicated by arrow E in FIG. 3. Then, the sheet feed roller 6 and the sheet reverse roller 5 separate the uppermost sheet from the sheet bundle P2, so that the uppermost sheet is conveyed toward the pair of registration rollers 111. Then, when it is detected that no sheet is left on the bottom plate 3, the loader elevation device lowers the bottom plate 3 to the lowest position. Consequently, the sheet transfer fence 8 that is located at the home position moves toward the sheet feed tray 1, so that the sheet transfer fence 8 shifts the sheet bundle P1 loaded on the sheet supply tray 2 to the sheet feed tray 1. Then, the sheet bundle P1 is shifted to the sheet feed tray 1 and the sheet transfer fence 8 has arrived at a transfer complete position, the sheet transfer fence 8 shifts backwardly or retreats toward the home position.

When no sheets are left on the sheet feed tray 1, the pair of side fences 7*a* and 7*b* of the sheet feed tray 1 transfers a sheet bundle loaded on the sheet supply tray 2 to the sheet feed tray 1 automatically. Therefore, it is difficult to adjust the pair of side fences 7*a* and 7*b* manually before the sheet bundle is transferred to the sheet feed tray 1. In order to address this inconvenience, a motor is caused to move the pair of side fences 7*a* and 7*b* automatically or the pair of side fences 7*a* and 7*b* is fixed to a predetermined position. A sheet bundle set in the sheet supply tray 2 may be different in width from another sheet bundles to cutting position error at sheet production. In a case in which a motor is driven to move the pair of side fences 7*a* and 7*b* automatically, when the sheet bundle P1 in the sheet supply tray 2 is transferred to the sheet feed tray 1, the pair of side fences 7*a* and 7*b* is retreated to a retreating position where the side fence 7*a* and the side fence 7*b* separate from each other to the maximum. Therefore, even if the width of the sheet bundle P2 in the sheet feed tray 1 is different from the width of another sheet bundle P1 in the sheet supply tray, the sheet bundle P1 can be transferred from the sheet supply tray 2 to the sheet feed tray 1 without being caught by the pair of side fences 7*a* and 7*b*. However, in this case, a moving mechanism to move the motor and the pair of side fences 7*a* and 7*b* is provided, and therefore it is likely that an increase in cost of an image forming apparatus due to an increase in the number of parts and an increase in size of the image forming apparatus.

In a comparative sheet feeding device, however, when conveying forces of a sheet feeding member become uneven due to installation environment of the comparative sheet feeding device and an image forming apparatus including the comparative sheet feeding device, the degree of a moment of rotation exerted by the sheet feeding member to the sheet changes. As a result, the moment of rotation exerted by the sheet feeding member to the sheet and the moment of rotation exerted by the load applying member to the sheet become imbalance. Consequently, the skew of the sheet fed from a sheet container cannot be prevented.

For the above-described reasons, the present embodiment provides the pair of side fences 7*a* and 7*b* secured at a predetermined position. Accordingly, when compared to a configuration in which a motor is driven to move the pair of side fences such as the pair of side fences 7*a* and 7*b*, the configuration of the present embodiment can reduce the number of parts, and therefore can reduce the cost and size of the image forming apparatus 100. However, if the side fences 7*a* and 7*b* are secured to respective positions corresponding to a predetermined width of sheet, when the width of the sheet P is greater than the predetermined width, it is likely that the sheet bundle is caught by the side fence 7*a* or the side fence 7*b* to cause the transfer failure of the sheet bundle. Accordingly, a distance between the side fence 7*a* and the side fence 7*b* is set to be greater than the predetermined width. However, in this case, if the width of a set sheet bundle is equal to or smaller than the predetermined width, the pair of side fences 7*a* and 7*b* cannot regulate the sheet P within the sheet width direction, and therefore the position in the width direction of the sheet to be transferred varies. As a result, the image forming position to the sheet also varies.

In the present embodiment, a pressing member is provided to the side fence 7*a* to press the sheet bundle loaded on the sheet feed tray 1 against the side fence 7*b* so as to regulate the sheet bundle in the width direction.

Figure 4A:
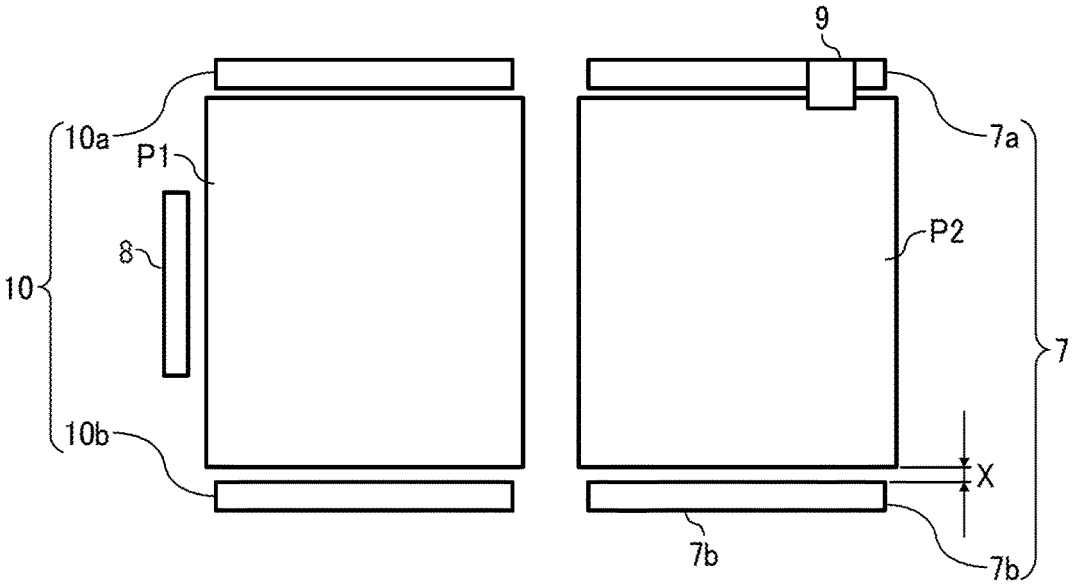
FIG. 4A is a plan view illustrating the tandem sheet tray in a state in which a bottom plate is at a lowest position.
Figure 4B:
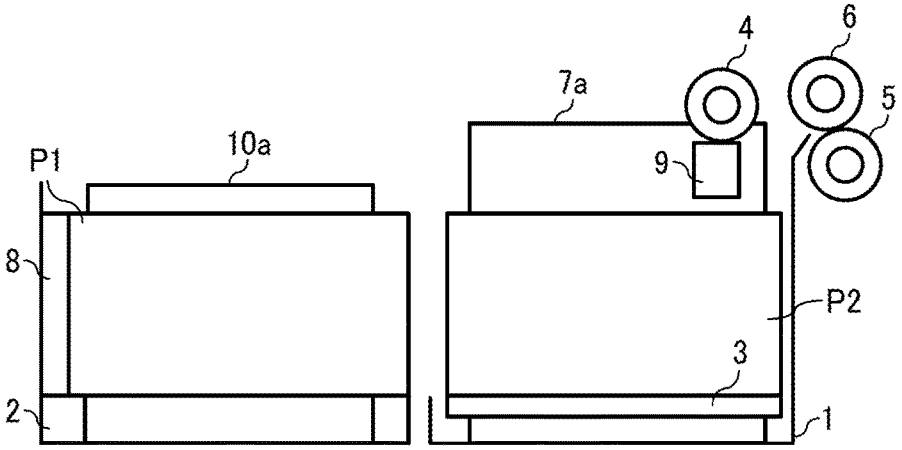
FIG. 4B is a side view illustrating the tandem sheet tray of FIG. 4A.
Figure 5A:
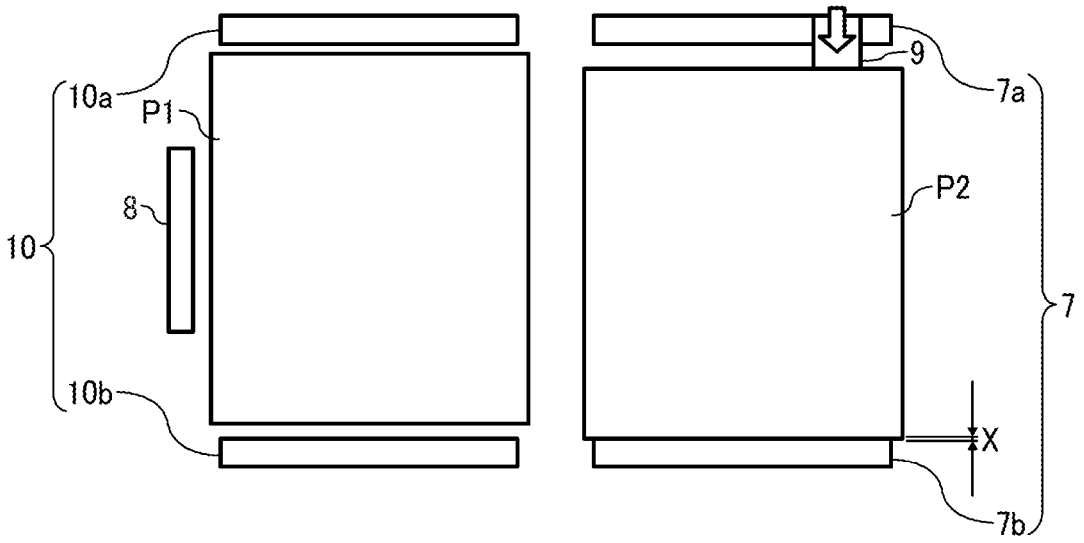
FIG. 5A is a plan view illustrating the tandem sheet tray in a state in which the bottom plate is elevated by a loader elevation device.
Figure 5B:
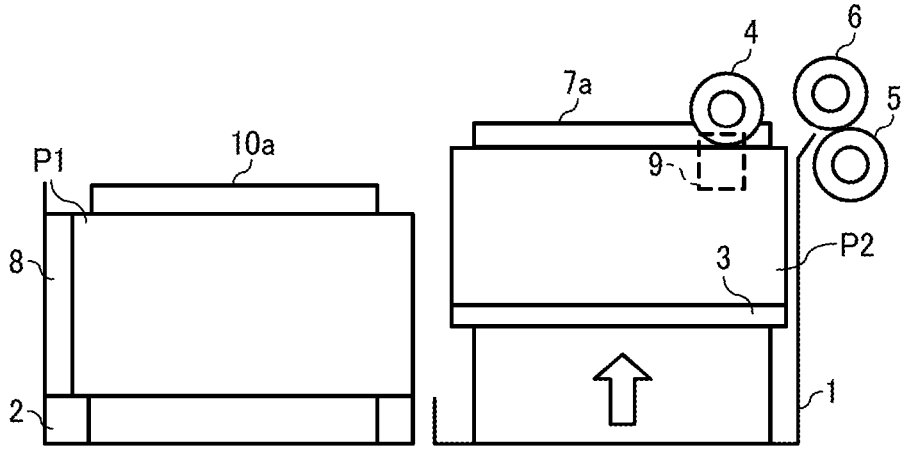
FIG. 5B is a side view illustrating the tandem sheet tray of FIG. 5A.

FIG. 4A is a plan view illustrating the tandem sheet tray 114*a* in a state in which the bottom plate 3 is at the lowest position. FIG. 4B is a side view illustrating the tandem sheet tray 114*a* of FIG. 4A. FIG. 5A is a plan view illustrating the tandem sheet tray 114*a* in a state in which the bottom plate 3 is elevated by the loader elevation device. FIG. 5B is a side view illustrating the tandem sheet tray 114*a* of FIG. 5A.

The sheet supply tray 2 includes a sheet transfer fence 8, a pair of side fences 10 including side fences 10*a* and 10*b*, and the sheet bundle P1. The bottom plate 3 that can load the sheet bundle P1 on the sheet feed tray 1 can be elevated and lowered by the loader elevation device. The sheet P elevated by the bottom plate 3 is conveyed by the sheet pickup roller 4, the sheet reverse roller 5, and the sheet feed roller 6.

A pressing member 9 is attached to the side fence 7*a*, which is one of the pair of side fences 7 (that is, 7*a* and 7*b*) that regulates a side end of the sheet P placed in the sheet feed tray 1. A pressure point at which the pressing member 9 presses the sheet P is located higher than a sheet full level of the sheet supply tray 2. As illustrated in FIGS. 5A and 5B, as the bottom plate 3 is elevated, the pressing member 9 presses the edge of the sheet. By so doing, a gap X between the sheet and the side fence 7*b*, which is the other of the pair of side fences 7 (that is, 7*a* and 7*b*), can be reduced.

Figure 6:
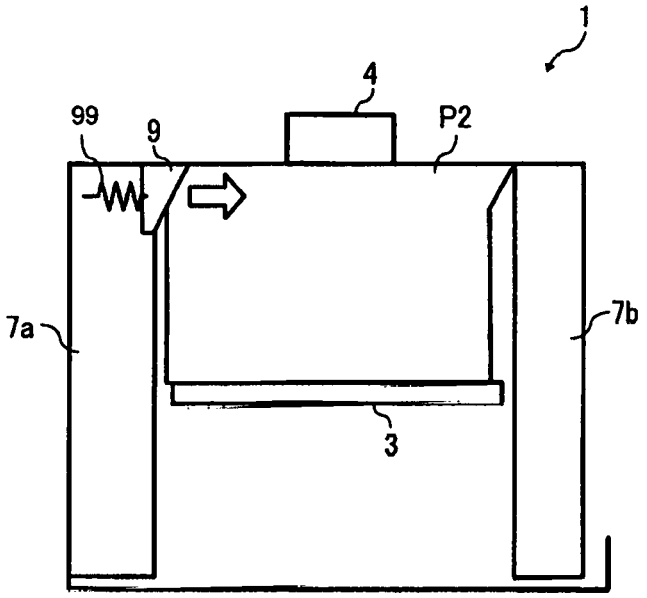
FIG. 6 is a diagram illustrating a sheet feed tray, viewed from an upstream side in a sheet feeding direction.

FIG. 6 is a diagram illustrating the sheet feed tray 1, viewed from the upstream side in the sheet feeding direction.

The pressing member 9 is biased by a pressure spring 99. When the pressing member 9 presses the sheet bundle P2 at an edge face in the sheet width direction perpendicular to the sheet feeding direction, a gap between the side fence 7*a* and the side fence 7*b* can be reduced. The pressing member 9 has a sloped face facing the edge of a sheet such as the sheet P, and a lower end portion of the pressing member 9 is not protruded from the side fence 7*a*. Therefore, the loader elevation device can elevate the bottom plate 3 without the sheet P being caught by the lower end portion of the pressing member 9. Accordingly, in a case in which the bottom plate 3 is lifted while the sheet bundle P2 is sliding along the side fence 7*a*, in other words, in a case in which a sheet bundle is loaded at any position in the sheet feed tray 1, the sheet P is not caught by the lower end portion of the pressing member 9 while the bottom plate 3 is being lifted and the position of the edge of the sheets in the sheet bundle can be aligned during the sheet feeding of the tandem sheet tray 114*a*.

When compared with a case in which the whole sheet P is pressed by the pressing member 9, when an upper end portion of the sheet bundle P2 is pressed by the pressing member 9, a pressing force to align the sheet P can be reduced. Accordingly, even when the number of sheets loaded on the bottom plate 3 becomes small, occurrence of buckling of the sheet P caused by an excessively large pressing force applied by the pressing member 9 can be reduced.

Figure 7A:
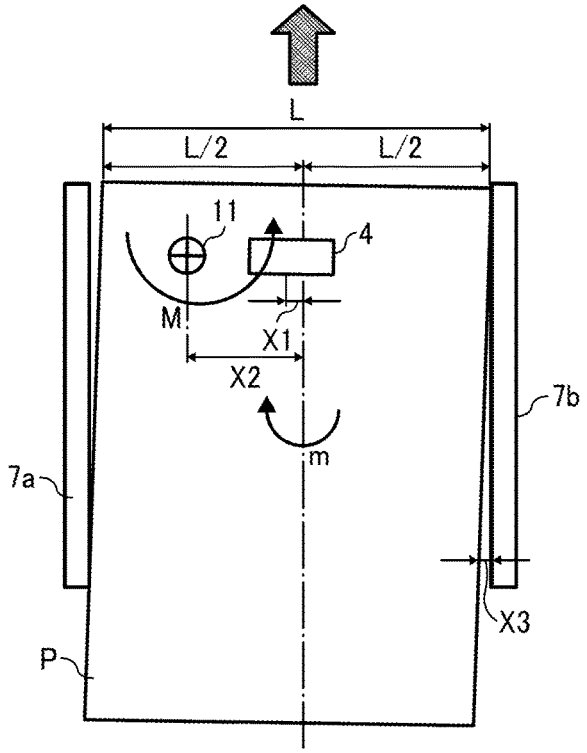
FIG. 7A is a top view illustrating the sheet feed tray related to a position and effect of a load applying member.
Figure 7B:
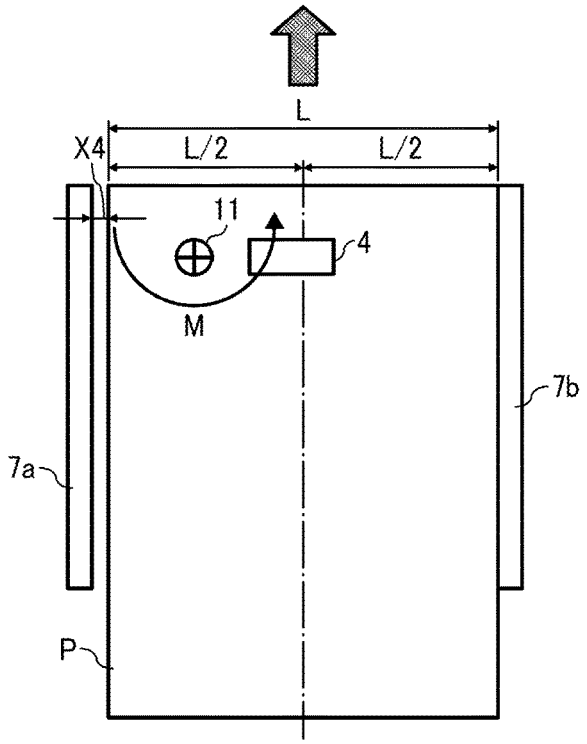
FIG. 7B is a top view illustrating the sheet feed tray related to another position and effect of the load applying member.

FIG. 7A is a top view illustrating the sheet feed tray 1 related to a position and effect of a load applying member 11. FIG. 7B is a top view illustrating the sheet feed tray 1 related to another position and effect of the load applying member 11.

The sheet pickup roller 4 is disposed to be located such that a center position of the sheet P in the sheet width direction to be at a center of sheet conveyance. In addition, the load applying member 11 is disposed near the sheet pickup roller 4 and between the sheet pickup roller 4 and the side fence 7*a*. The position of the load applying member 11 is separated from the center of the sheet P by a distance X2.

It is to be noted that the center of sheet conveyance in the sheet P having a width L is at a position by L/2 from an inner side face of the side fence 7*b* in the sheet width direction of the sheet P.

Figure 8A:
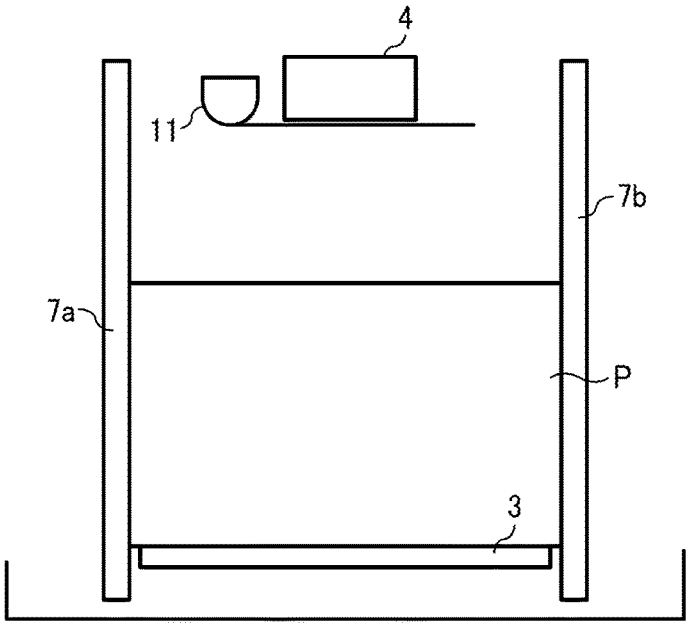
FIG. 8A is a diagram illustrating operations of the load applying member and a sheet pickup roller when the bottom plate is at the lowest portion.
Figure 8B:
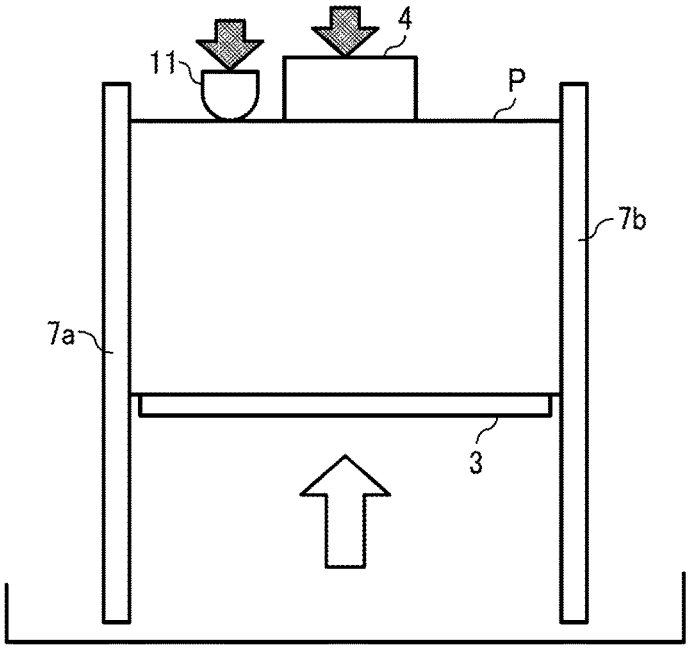
FIG. 8B is a diagram illustrating operations of the load applying member and the sheet pickup roller at elevation of the bottom plate.

FIG. 8A is a diagram illustrating operations of the load applying member 11 and the sheet pickup roller 4 when the bottom plate 3 is at the lowest portion. FIG. 8B is a diagram illustrating operations of the load applying member 11 and the sheet pickup roller 4 at elevation of the bottom plate 3.

The bottom plate 3 with the sheet bundle P is loaded thereon elevates in an upward direction of FIGS. 8A and 8B. As the bottom plate 3 is lifted, the sheet bundle P comes to contact the load applying member 11 and the lower face of the sheet pickup roller 4 at a standby position. Then, the sheet bundle P is pressed in a direction indicated black arrow by the biasing force.

As illustrated in FIG. 8A, the lower face position of the load applying member 11 at a standby state is lower than a contact face (that is, the lower face position) of the pickup roller 4 to contact the sheet P in the standby state. The bottom plate 3 with the sheet bundle P is loaded thereon elevates in an upward direction of FIGS. 8A and 8B. As the bottom plate 3 is lifted, the sheet bundle P comes to contact the load applying member 11 and the lower face of the sheet pickup roller 4 at the standby position. Then, the sheet bundle P is pressed in a direction indicated black arrow by the biasing force. As illustrated in FIG. 8A, the lower face position of the load applying member 11 at the standby state is lower than a contact face (that is, the lower face position) of the pickup roller 4 to contact the sheet P at the standby condition.

Figure 9A:
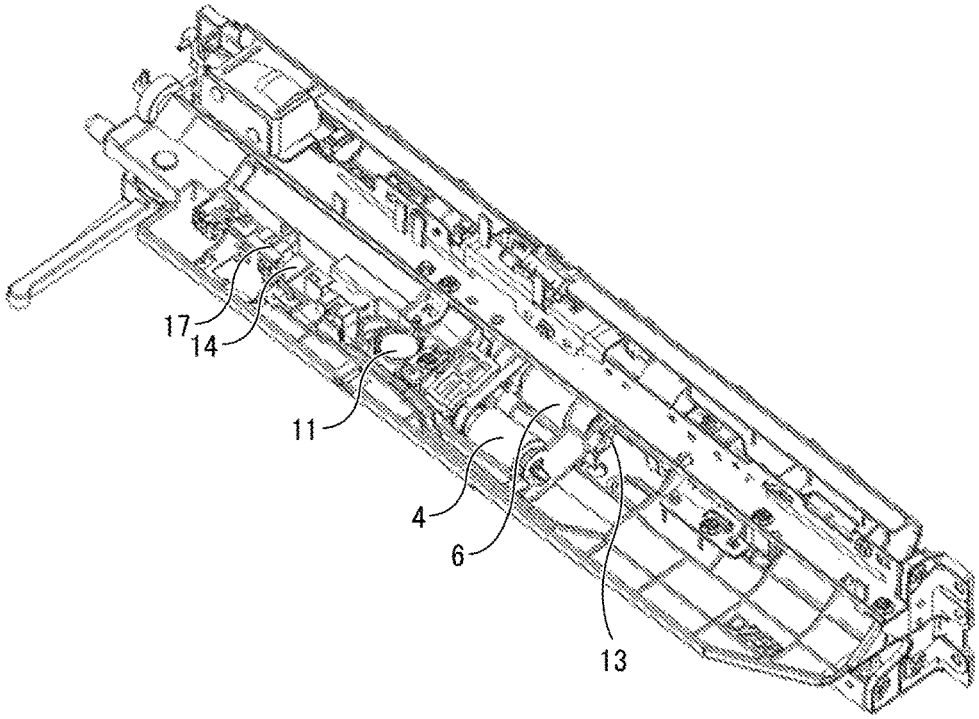
FIG. 9A is a perspective view illustrating a sheet feeding device included in the image forming apparatus of FIG. 1.
Figure 9B:
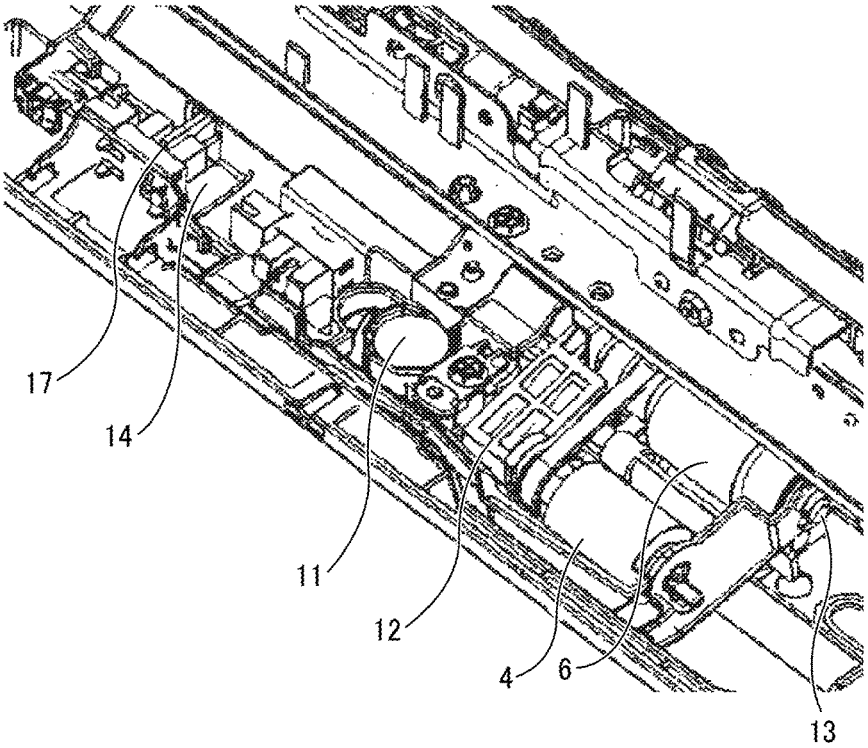
FIG. 9B is an enlarged perspective view illustrating the sheet feeding device of FIG. 9A.

FIG. 9A is a perspective view illustrating the sheet feeding device 114, mainly a downstream side in the sheet feeding direction. FIG. 9B is an enlarged perspective view illustrating the sheet feeding 114, mainly the downstream side in the sheet feeding direction.

The pickup roller 4 is rotatably supported by a pickup arm 12. The pickup arm 12 is disposed to rotate about a sheet feed shaft 13 that pivotally supports the sheet feed roller 6. A position detecting sensor 14 is attached to the sheet feeding device 114. The position detecting sensor 14 reads a position of a sensing portion 17 of the pickup arm 12, so that the bottom plate 3 is controlled to be located at a constant height.

A position detecting sensor 14 is attached to the sheet feeding device 114. The position detecting sensor 14 reads a position of a sensing portion 17 of the pickup arm 12, so that the bottom plate 3 is controlled to be located at a constant height. As an example of the control, the position detecting sensor 14 turns off when the sheet pickup roller 4 is in a standby state. When the bottom plate 3 is lifted, the pickup arm 12 contacts the uppermost sheet of the sheet bundle P. Then, when an amount of pressure applied by the pickup arm 12 reaches a predetermined amount, the position detecting sensor 14 turns on, and then the bottom plate 3 is stopped. As the height of the uppermost sheet of the sheet bundle P becomes lower during a serial sheet feeding, the pickup arm 12 gradually rotates. When the position detecting sensor 14 turns off, the bottom plate 3 is lifted again. (When the position detecting sensor 14 turns on, the bottom plate 3 is stopped again.) At this time, the position of the sheet pickup roller 4 is controlled to be higher than the position in the standby state. Therefore, the serial sheet feeding can be performed. Further, the height of the sheet pickup roller 4 in the standby state is set to be lower than the height of the load applying member 11 in the standby state. Accordingly, the load applying member 11 contacts and presses the uppermost sheet of the sheet bundle P reliably without whiffing and failing to contact the uppermost sheet.

As illustrated in FIGS. 7A and 7B, the sheet pickup roller 4 is disposed between the side fence 7*a* and the load applying member 11. At the same time, the side fence 7*b* is disposed facing the side fence 7*a* to substantially align the center of sheet conveyance that is the center of axial direction of the sheet pickup roller 4 and the sheet center position that is the center in the sheet width direction of the sheet P. It is to be noted that an absolute reference conveyance position in the sheet width direction of the sheet P that is to be fed by the sheet pickup roller 4 corresponds to the position of the inner side face of the side fence 7*b*.

When the sheet P is conveyed in a direction indicated by black arrow in FIGS. 7A and 7B, a moment of rotation "m" and a moment of rotation "M" are applied to the sheet P along with a distance X1, the distance X2, a pressing force of the sheet pickup roller 4, and a pressing force of the load applying member 11. The moment of rotation "m" is a force that is exerted by the sheet pickup roller 4 at the sheet pickup roller 4 as the center of rotation. The moment of rotation "M" is a force that is exerted by the sheet pickup roller 4 at the load applying member 11 as the center of rotation. The distance X1 is a distance between the sheet center position and the center of sheet conveyance. The distance X2 is a distance between the sheet center position and the center of the load applying member 11.

Here, by setting to meet a relation of the moment of rotation "m"<the moment of rotation "M", the sheet P can be rotated in a direction in which the trailing end of the sheet P is shifted toward the side fence 7*b*. With the rotation of the sheet P, a gap X3 is reduced. Consequently, the position of the edge in the sheet width direction of the sheet P can be accurately aligned on the basis of the side fence 7*b*.

It is to be noted that, even when the position of the sheet pickup roller 4 is shifted from the center of sheet conveyance toward the side fence 7*a* due to installation error, a sufficient amount of moment of rotation "M" is applied to the sheet P. Therefore, the sheet P can be rotated in the direction in which the trailing end of the sheet P is shifted toward the side fence 7*b* reliably. In addition, the load applying member 11 in the sheet feeding direction can be located at any position as long as a load applied from the side fence 7*a* is applied at the center of rotation to rotate the sheet P.

Further, the sheet pickup roller 4 is disposed at a position substantially the center in the sheet width direction, so as to reduce the moment of rotation "m". By so doing, even when the moment of rotation "M" is reduced, the above-described relation of the moment of rotation "m" and the moment of rotation "M" (m<M) can be maintained easily. As an example of setting the sheet pickup roller 4 at a substantially center position in the sheet width direction, the pair of side fences 7 has a configuration of rack and pinion gears, for example, to open and close in conjunction with each other so as to match the center of sheet conveyance and the sheet center position. In addition, even when stabilized papers or thin papers are used under a high temperature high humidity environment, the moment of rotation "M" is preferably kept small in order to restrain occurrence of damage to the sheet P.

Figure 10A:
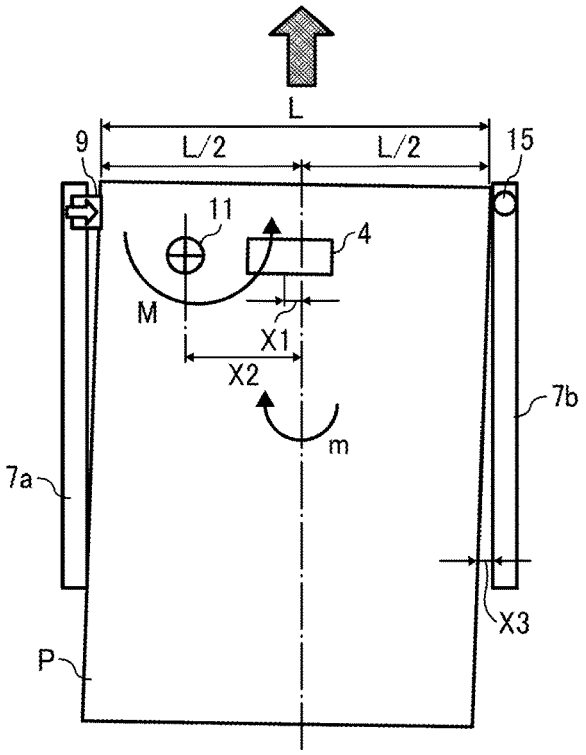
FIG. 10A is a top view illustrating the sheet feed tray with the pressing member and the regulating member on the pair of side fences with a gap.
Figure 10B:
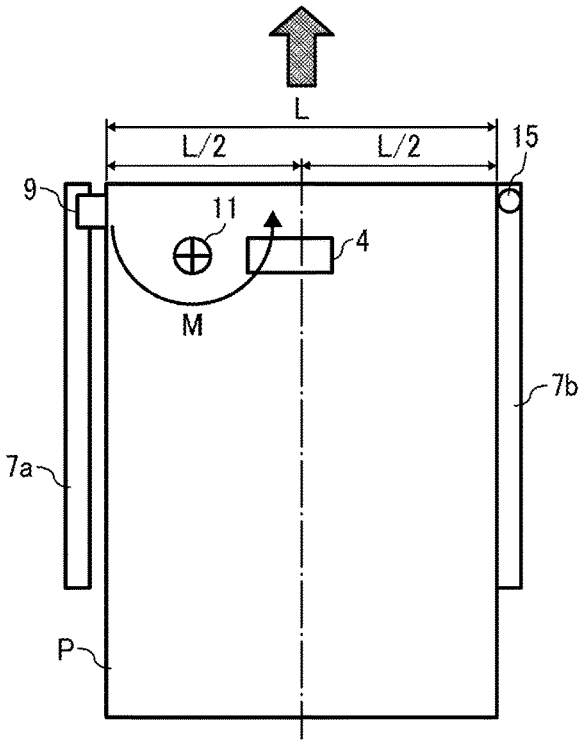
FIG. 10B is a top view illustrating the sheet feed tray with the pressing member and the regulating member on the pair of side fences with another gap.

FIG. 10A is a top view illustrating the sheet feed tray 1 with the pressing member 9 to the side fence 7*a* and a regulating member 15 to the side fence 7*b* with a gap. FIG. 10B is a top view illustrating the sheet feed tray 1 with the pressing member 9 to the side fence 7*a* and the regulating member 15 to the side fence 7*b* with another gap.

As previously illustrated in FIG. 6, the pressing member 9 presses the upper end of the sheet bundle P2 so that the side edge of the sheet P can be aligned to the side fence 7*b*. The regulating member 15 is attached to the side fence 7*a*. When the sheet P is held between the pressing member 9 and the regulating member 15 at the downstream side of the sheet feeding direction, the side edge of the sheet P in the sheet width direction can be aligned along the side fence 7*b* with a rotational force applied by the load applying member 11 highly accurately. Consequently, occurrence of a gap X4 between the side fence 7*b* and the sheet P can be reduced.

The regulating member 15 includes a material of metal or polyacetal (POM) resin, and therefore provides a good sliding performance. Accordingly, a sheet conveyance load of the sheet P can be reduced. Further, in the present embodiment, the regulating member 15 is provided as a separate part to be attached to the side fence 7*b*. However, the regulating member 15 can be replaced to a regulating portion that is a projection formed on a part of the side fence 7*b*. Consequently, the number of parts included in the pair of side fences 7 can be reduced. In addition, a sheet metal can function as a regulating member to be attached on a side face of the side fence 7*b* facing the sheet P. By so doing, the whole area of the side face of the side fence 7*b* facing the sheet P can function as a regulating member. Accordingly, the side face of the side fence 7*b* facing the sheet P can restrain wear generated due to sliding with the sheet P.

Figure 11A:
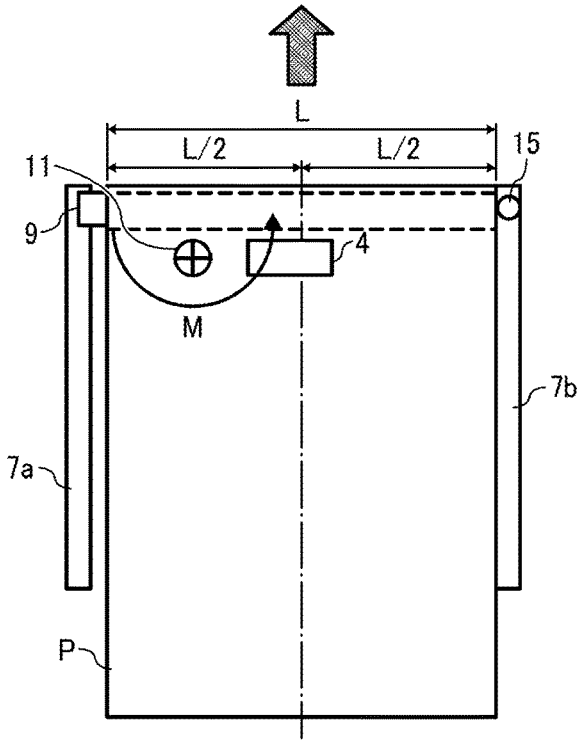
FIG. 11A is a top view illustrating the sheet feed tray with the pressing member and the regulating member are located at an approximately identical position to each other in the sheet feeding direction.
Figure 11B:
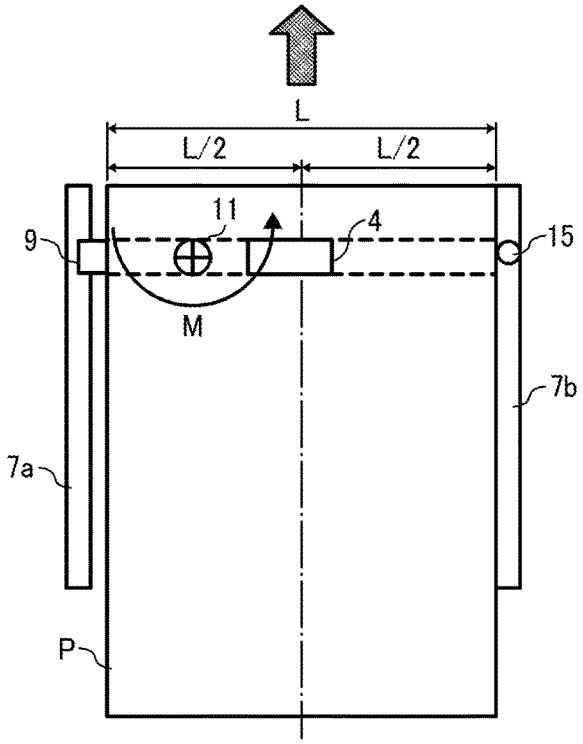
FIG. 11B is a top view illustrating the sheet feed tray with the pressing member and the regulating member are located at an approximately identical position to each other in the sheet feeding direction, different from FIG. 11A.

FIG. 11A is a top view illustrating the sheet feed tray 1 with the pressing member 9 and the regulating member 15 are located at an approximately identical position to each other in the sheet feeding direction. FIG. 11B is a top view illustrating the sheet feed tray 1 with the pressing member 9 and the regulating member 15 are located at an approximately identical position to each other in the sheet feeding direction, different from FIG. 11A.

Further, as illustrated in FIG. 11A, the pressing member 9 and the regulating member 15 are disposed at a substantially identical position in the sheet feeding direction, as indicated by dotted lines. By so doing, the center of rotation of the sheet P is stabilized, and therefore highly accurate image forming position can be expected.

Further, as illustrated in FIG. 11B, the respective positions of the pressing member 9 and the regulating member 15 in the sheet feeding direction may be located to be substantially identical to the sheet pickup roller 4 and the load applying member 11. By so doing, calculation of moments such as the moment of rotation "m" and the moment of rotation "M" can be performed easily.

By contrast, as illustrated in FIG. 11A, it is preferable that the pressing member 9 and the regulating member 15 are located at a relatively downstream side of the sheet feeding direction, so that the position of the edge of the sheet P becomes stable at an exit of the sheet feed tray 1.

Embodiment 2

In Embodiment 2, the level of a load applied by the load applying member 11 to the sheet P is changeable.

Figure 12:
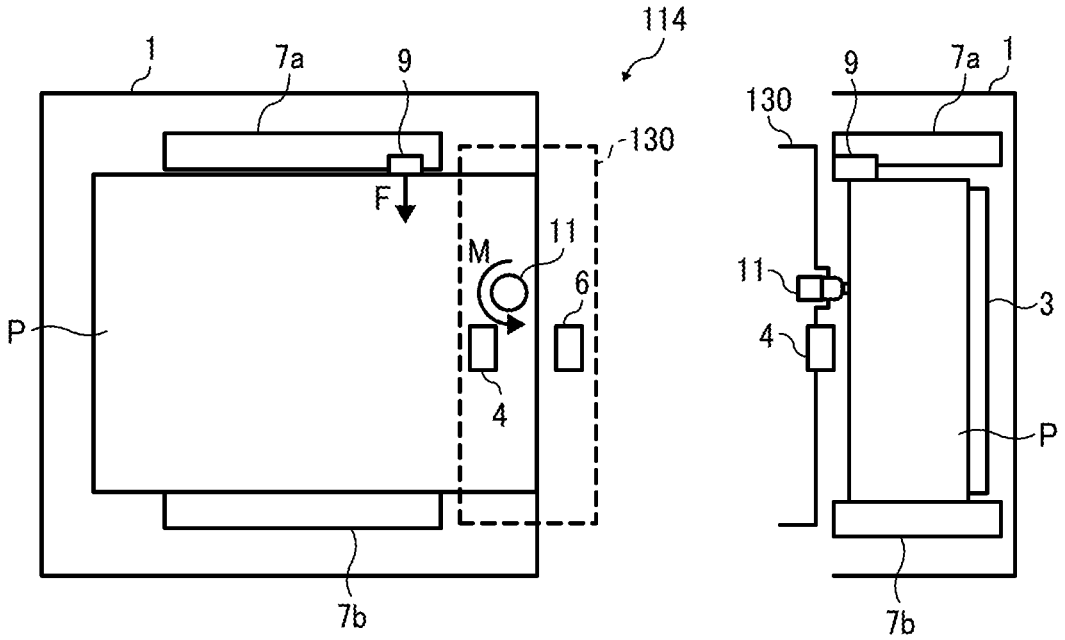
FIG. 12 is a diagram illustrating a configuration with a load applying member to apply a load to a sheet during conveyance, for aligning the sheet along the pair of side fences by a moment of rotation applied by the load applying member.

FIG. 12 is a diagram illustrating a configuration with the load applying member 11 to apply a load to the sheet P during sheet conveyance, so that the sheet P is aligned to the side fence 7*b* by the moment of rotation "M" applied by the load applying member 11.

In FIG. 12, the side fence 7*b* is a reference member in the sheet width direction, which is a direction perpendicular to the sheet feeding direction. By applying a load of a force F by the pressing member 9 to the end face of the sheet P in the sheet width direction, a gap between the side fence 7*a* and the side fence 7*b* is reduced at the leading end of the sheet P.

Further, as the load applying member 11 applies the moment of rotation "M" to the sheet P, a gap between the side fence 7*a* and the side fence 7*b* is reduced at the trailing end of the sheet P.

Accordingly, even when the sheet P is set on the sheet feed tray 1 with a gap relative to the side fence 7*b*, the sheet P can be aligned at the side fence 7*b* that is a reference member in the sheet width direction. Therefore, the sheet P can be fed without skew.

The load applying member 11 applies not only the moment of rotation "M" to the sheet P but also a load in a sheet loading direction, which is a vertical direction or a height direction of the sheet bundle P. When the load applied to the sheet loading direction is excessively large, an amount of adhesion between adjacent sheets increases, resulting in misfeeding and generation of creases in sheets due to excess moment.

By contrast, when the load applied to the sheet loading direction is relatively small, the amount of moment becomes short, and therefore the sheet P cannot be aligned to the side fence 7*b*.

The adhesion between adjacent sheets depends on sheet size, sheet thickness, and environment, it is preferable that the load applied by the load applying member 11 can be changed according to sheet size, sheet thickness, and environment.

Further, when misfeeding due to the adhesion between adjacent sheets is considered, it is preferable that the load applied by the load applying member 11 is smaller. Therefore, in order to provide a sufficient moment of rotation "M" with a small load, it is preferable that the load applying member 11 is disposed at a position separated from the center of the sheet P. Specifically, as the sheet size increases, the sufficient moment of rotation "M" also increases. Therefore, it is preferable that a loading position at which the load applying member 11 applies a load to the sheet P can be changed.

As illustrated in FIG. 12, part of a lower face of the load applying member 11 is supported by a housing 130 of the sheet feeding device 114. As the bottom plate 3 elevates, the load applying member 11 is lifted in an upward direction. According to this operation, a body weight of the load applying member 11 is added as a load to the sheet P.

The load applying member 11 is not fixed to the housing 130, and therefore can be removed easily. Since multiple load applying members 11 having different weights are constantly prepared, any one of the multiple load applying members 11 can be selected and replaced. By so doing, a load can be changed to be applicable to sheet size, sheet thickness, sheet type, and environment.

Further, in an image forming apparatus in which unspecified users use various types of sheets P, the load applying member 11 may not be installed in the housing 130 at factory shipping, so that the load applying member 11 can be added accordingly after the shipping.

It is to be noted that the above-described load applying method by the load applying member 11 to the sheet P uses the own weight of the load applying member 11. However, the load applying method is not limited thereto. Specifically, a spring may be employed to function as a biasing member to bias the load applying member 11 to the sheet P. That is, by applying a biasing force by the spring to the load applying member 11, the load applying member 11 can apply a load to the sheet P. In such a configuration, multiple springs having different spring constants are prepared. According to the sheet size, sheet thickness, sheet type, and environment, an appropriate spring is selected from the multiple springs. By so doing, the load applied by the load applying member 11 to the sheet P can be changed.

Further, by changing the compression height of the spring, the load applied by the load applying member 11 to the sheet P can be changed.

Figure 13:
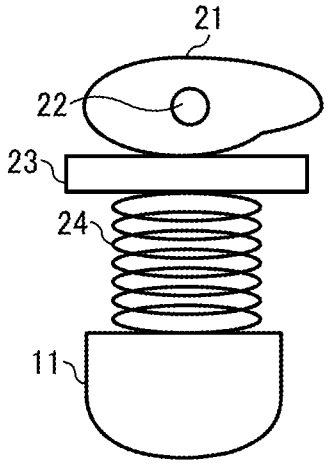
FIG. 13 is a diagram illustrating a configuration in which a pressure spring biases the load applying member.
Figure 14:
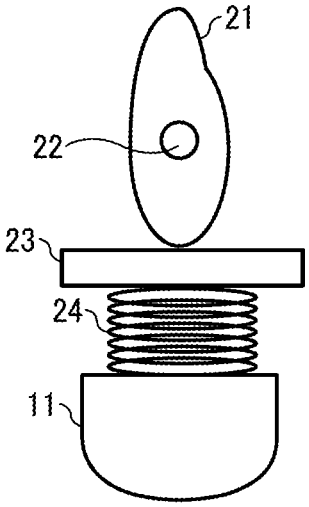
FIG. 14 is a diagram illustrating a state in which a height of compression of the pressure spring, compared with the configuration in FIG. 13.

FIG. 13 is a diagram illustrating a configuration in which a pressure spring 24 biases the load applying member 11. FIG. 14 is a diagram illustrating a state in which the compression height of the pressure spring 24 is changed from the configuration in FIG. 13.

The pressure spring 24 is mounted on the load applying member 11 in FIG. 13 to bias the load applying member 11 to the sheet P. By using the biasing force applied by the pressure spring 24, the load applying member 11 applies a load to the sheet P. While the load applying member 11 is provided at one end of the pressure spring 24, a seat 23 is provided at the other end of the pressure spring 24. The position of the seat 23 can be changed by a cam 21 that rotates about a rotation center shaft 22. For example, the cam 21 has a lever shaped portion. When the lever shaped portion of the cam 21 is rotated, a cam face of the cam 21 that contacts the seat 23 is changed, and the position of the seat 23 is also changed. Along with these changes related to the cam 21 and the seat 23, the compression height of the pressure spring 24 changes. Consequently, according to the compression height of the pressure spring 24, the biasing force of the load applying member 11 applied by the pressure spring 24 changes. As a result, the level of load applied by the load applying member 11 to the sheet P can be changed.

Further, change of the shape of the cam 21 can adjust the compression height of the pressure spring 24 to a target load.

Further, instead of the cam 21, an attachment opening can be formed on the housing 130, so that the seat 23 can be installed and removed through the attachment opening. With this configuration, a load applied by the load applying member 11 to the sheet P can be changed.

Figure 15:
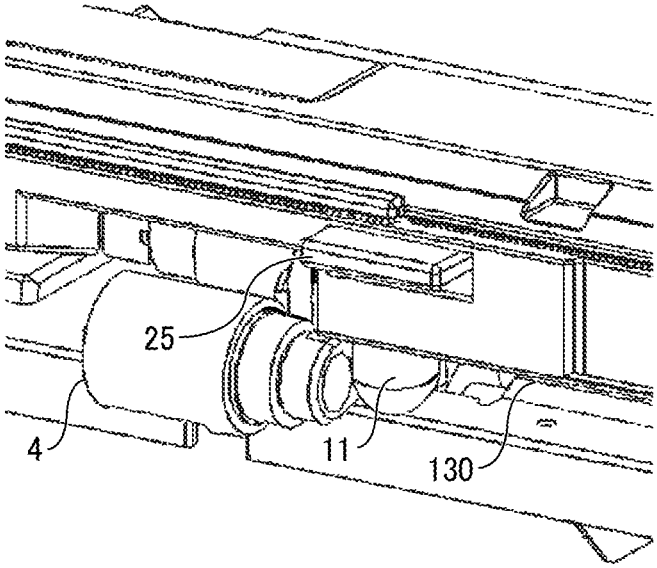
FIG. 15 is a perspective view illustrating a sheet feeding device provided with the load applying member.
Figure 16:
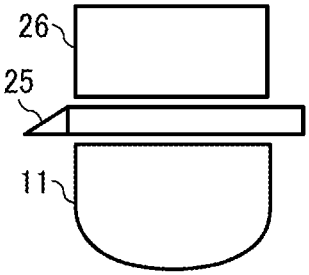
FIG. 16 is a diagram illustrating a state in which a load of a weight is not applied to the load applying member.
Figure 17:
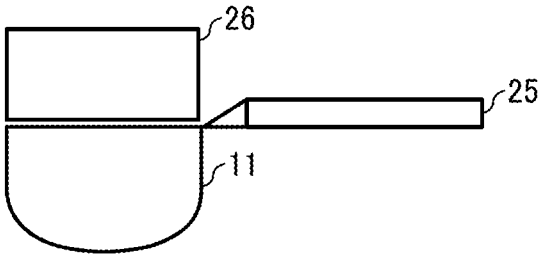
FIG. 17 is a diagram illustrating a state in which a weight load of a weight is applied to the load applying member.

FIG. 15 is a perspective view illustrating the sheet feeding device 114 provided with the load applying member 11. FIG. 16 is a diagram illustrating a state in which a weight load of a weight 26 is not applied to the load applying member 11. FIG. 17 is a diagram illustrating a state in which the weight load of the weight 26 is applied to the load applying member 11.

In the configurations of FIGS. 16 and 17, the level of load applied by the load applying member 11 to the sheet P can be changed with the weight 26. The load applying member 11 illustrated in FIGS. 16 and 17 includes a weight.

In FIG. 16, the weight 26 that is different from the load applying member 11 is held on a lever 25 that is slidable along rail grooves provided to the housing 130. In the state illustrated in FIG. 16, the weight load of the weight 26 is not applied to the load applying member 11. As the lever 25 is slid as illustrated in FIG. 17, the lever 25 is released from holding the weight 26. As a result, the weight 26 is placed on the upper face of the load applying member 11, and therefore the weight load of the weight 26 is applied to the load applying member 11. By slidably placing and removing the lever 25, application of the weight load of the weight 26 to the load applying member 11 is switched. Accordingly, the level of load applied by the load applying member 11 to the sheet P can be changed.

Embodiment 3

Figure 18A:
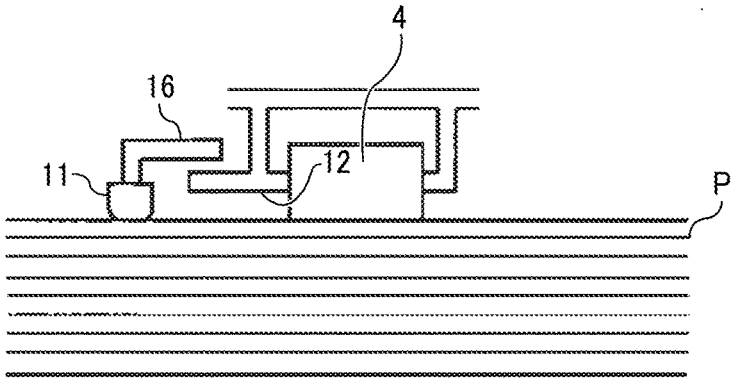
FIG. 18A is a diagram illustrating a state in which a pickup arm is located at a lowered position.
Figure 18B:
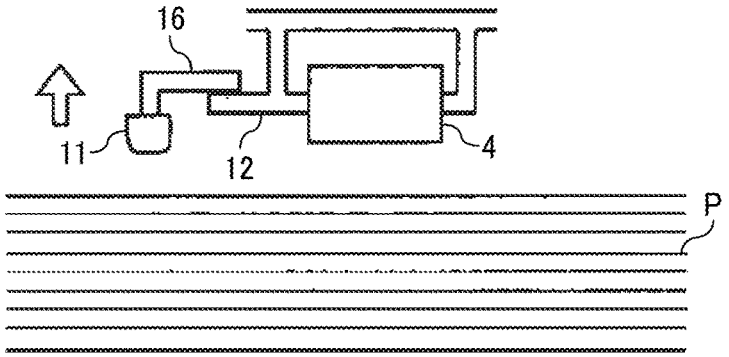
FIG. 18B is a diagram illustrating a state in which the pickup arm is located at a lifted position.

FIG. 18A is a diagram illustrating a state in which the pickup arm 12 is located at a lowered position. FIG. 18B is a diagram illustrating a state in which the pickup arm 12 is located at a lifted position.

In Embodiment 3, when the pickup arm 12 is lifted, the load applying member 11 is lifted together with the pickup arm 12, thereby releasing the load applied by the load applying member 11 to the sheet P.

A pickup arm link member 16 is attached to an upper part of the load applying member 11. The pickup arm link member 16 contacts to and separates from the pickup arm 12 along with lifting and lowering of the pickup arm 12. As illustrated in FIG. 18A, when the sheet pickup roller 4 is in contact with the sheet P, that is, when the pickup arm 12 is located at the lowered position, the pickup arm 12 and the pickup arm link member 16 are separated and are not in contact with each other, and therefore the load applying member 11 applies a load to the sheet P. By contrast, as illustrated in FIG. 18B, when the sheet pickup roller 4 is separated from the sheet P, that is, when the pickup arm 12 is located at the lifted position, the pickup arm link member 16 moves upwardly together with the movement of the pickup arm 12. With this operation, the pickup arm link member 16 is lifted by the pickup arm 12 from below. Therefore, the load applying member 11 to which the pickup arm link member 16 is attached is separated from the sheet P, thereby not applying a load to the sheet P.

As described above, in the present embodiment, the load applying member 11 contacts and separates the sheet P along with the lifting and lowering of the pickup arm 12. Consequently, as illustrated in FIG. 18A, when the pickup arm 12 is located at the lowered position and the sheet pickup roller 4 contacts the sheet P to perform a sheet feeding operation, the load applying member 11 applies a load to the sheet P, so that the sheet P is aligned to the side fence 7*b* by the moment of rotation "M". Further, as illustrated in FIG. 18B, when the pickup arm 12 is located at the lifted position and the sheet pickup roller 4 stops the sheet feeding operation, the load applying member 11 does not apply a load to the sheet P, so that the moment of rotation "M" is not applied to the sheet P. Accordingly, by applying a load applied by the load applying member 11 and the moment of rotation "M" to the sheet P for a relatively long period of time during sheet conveyance, occurrence of wrinkles and gloss streaks in the sheet P can be restrained.

Figure 19:
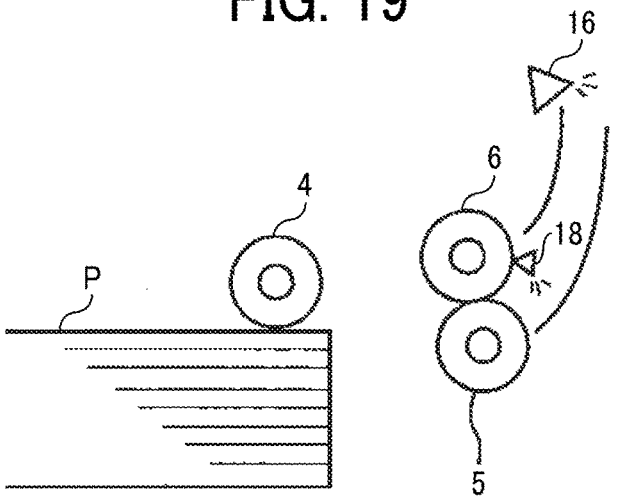
FIG. 19 is a diagram illustrating a position of a sheet feed sensor and a position of a sheet conveyance sensor.
Figure 20:
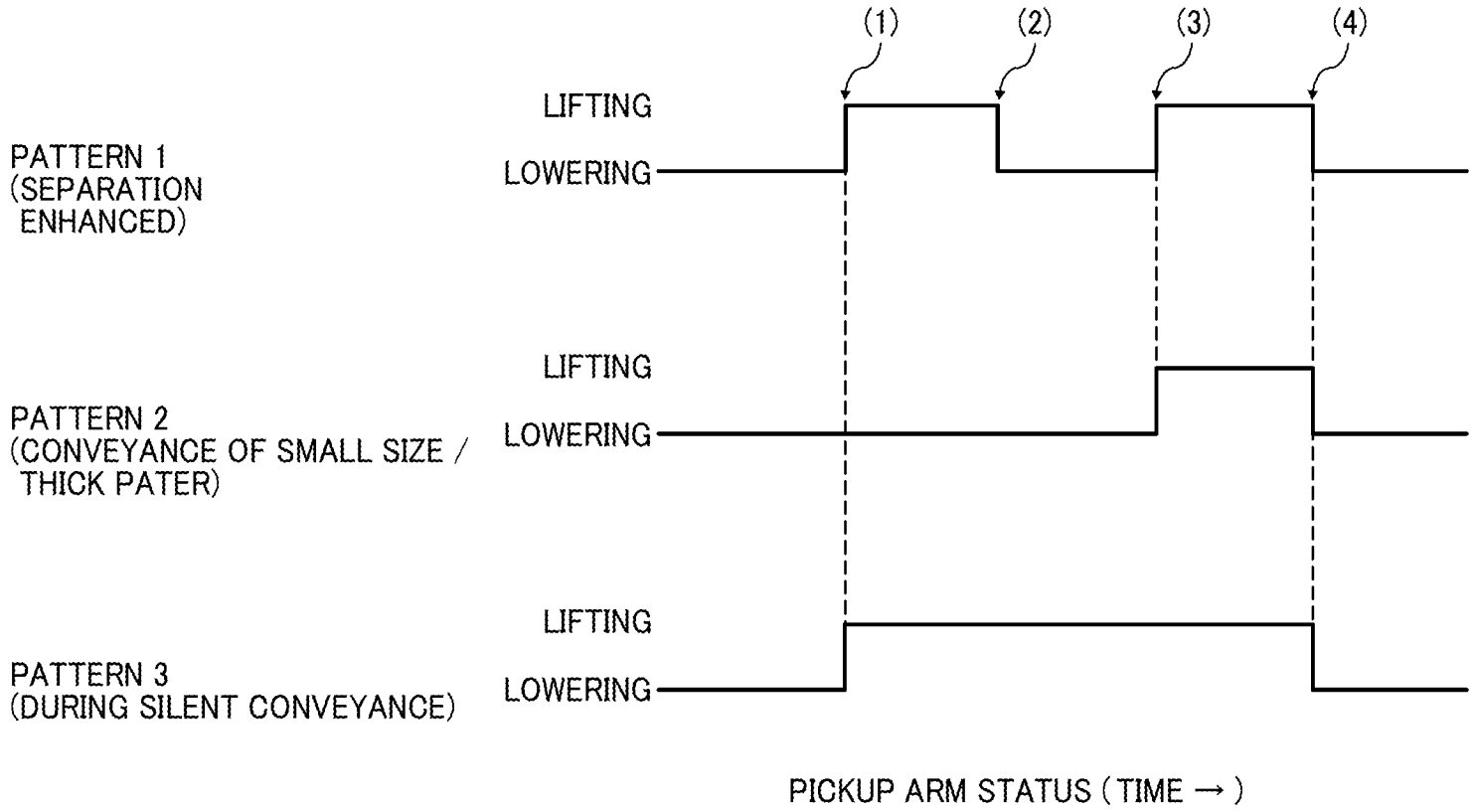
FIG. 20 is a timing chart of liftings and lowerings of the pickup arm.

In the present embodiment, as illustrated in FIG. 19, a sheet feed sensor 18 is disposed in the sheet conveying passage and near and downstream from the sheet reverse roller 5 and the sheet feed roller 6 in the sheet feeding direction. Further, a sheet conveyance sensor 19 is disposed downstream from the sheet feed sensor 18 in the sheet feeding direction. As illustrated in FIG. 20, the lifting and lowering of the pickup arm 12 is controlled according to detection timings of the leading end of the sheet P by the sheet feed sensor 18 and the sheet conveyance sensor 19.

FIG. 20 is a timing chart of liftings and lowerings of the pickup arm 12.

In the timing chart of FIG. 20, "Pattern 1 (Separation Enhanced)" indicates a step in which, when the sheet feed sensor 18 detects the leading end of the sheet P, the pickup arm 12 located at the lowered position is lifted to the lifted position. This step is indicated as (1) in the timing chart of FIG. 20.

Then, when the sheet conveyance sensor 19 detects the leading end of the sheet P, the pickup arm 12 located at the lifted position is lowered to the lowered position. This step is indicated as (2) in the timing chart of FIG. 20.

Then, on arrival of the trailing end of the sheet P at a position 15 mm before the sheet pickup roller 4 in the sheet feeding direction, the pickup arm 12 located at the lowered position is lifted to the lifted position. This step is indicated as (3) in the timing chart of FIG. 20.

Then, on arrival of the trailing end of the sheet P at a position 10 mm before the sheet feed roller 6 in the sheet feeding direction, the pickup arm 12 located at the lifted position is lowered to the lowered position. This step is indicated as (4) in the timing chart of FIG. 20.

It is to be noted that the timing of arrival of the trailing end of the sheet P at the position 15 mm before the sheet pickup roller 4 in the sheet feeding direction and the timing of arrival of the trailing end of the sheet P at the position 10 mm before the sheet feed roller 6 in the sheet feeding direction can be grasped based on respective elapsed times from the sheet feed start timing.

In "Pattern 2 (Conveyance of Small Size/Thick Paper)" in the timing chart of FIG. 20, the pickup arm 12 is not lifted or lowered at the timing at which either the sheet feed sensor 18 or the sheet conveyance sensor 19 detects the leading end of the sheet P. That is, the pickup arm 12 remains at the lowered position when the leading end of the sheet P is detected in Pattern 2.

Then, on arrival of the trailing end of the sheet P at the position 15 mm before the sheet pickup roller 4 in the sheet feeding direction, the pickup arm 12 at the lowered position is lifted to the lifted position.

Thereafter, on arrival of the trailing end of the sheet P at the position 10 mm before the sheet feed roller 6 in the sheet feeding direction, the pickup arm 12 at the lifted position is lowered to the lowered position.

In "Pattern 3 (During Silent Conveyance)" in the timing chart of FIG. 20, the pickup arm 12 located at the lowered position is lifted to the lifted position when the sheet feed sensor 18 detects the leading end of the sheet P.

Then, the pickup arm 12 is not lifted or lowered at the timing at which the sheet conveyance sensor 19 detects the leading end of the sheet P or at the timing on arrival of the trailing end of the sheet P at the position 15 mm before the sheet pickup roller 4 in the sheet feeding direction. That is, the pickup arm 12 remains at the lifted position when the leading end of the sheet P is detected or the trailing end of the sheet P is arrived at the above-described position in Pattern 3.

Then, on arrival of the trailing end of the sheet P at the position 10 mm before the sheet feed roller 6 in the sheet feeding direction, the pickup arm 12 at the lifted position is lowered to the lowered position.

Embodiment 4

Figure 21:
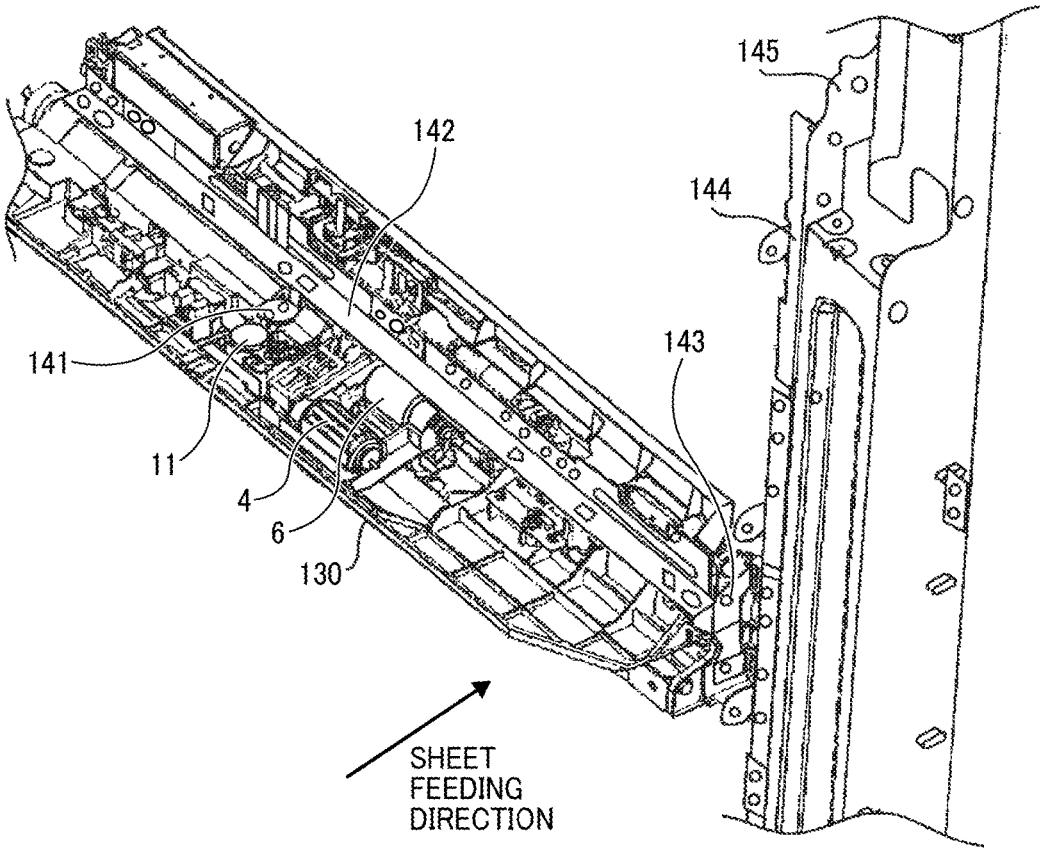
FIG. 21 is a diagram illustrating an electrical grounding passage from the load applying member.
Figure 22:
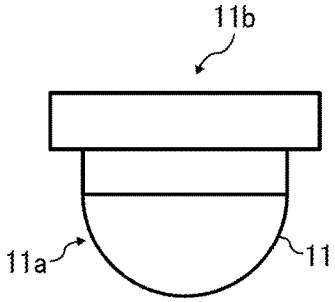
FIG. 22 is a diagram illustrating the load applying member including a sheet contact portion and a pressing portion.
Figure 23:
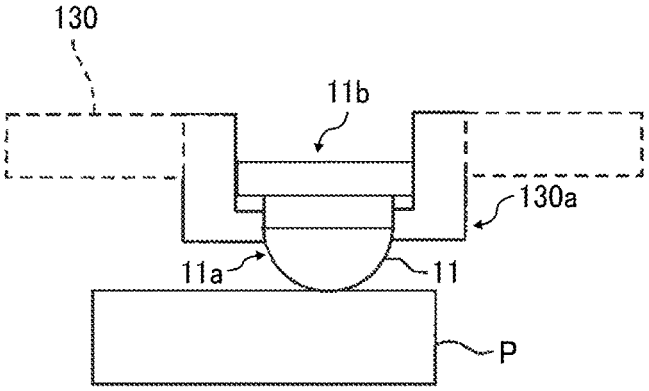
FIG. 23 is a diagram illustrating a configuration of a holder provided to a housing and the load applying member.

FIG. 21 is a diagram illustrating an electrical grounding passage from the load applying member 11. FIG. 22 is a diagram illustrating the load applying member 11 including a sheet contact portion 11*a* and a pressing portion 11*b*. FIG. 23 is a diagram illustrating a configuration of a holder 130*a* provided to the housing 130 and the load applying member 11.

In Embodiment 4, as illustrated in FIG. 21, an electrical grounding passage is defined by the load applying member 11, a leaf spring 141 that is screwed to a stay 142, the stay 142, a leaf spring 143 that is screwed to a side plate 144, the side plate 144, and a frame 145. Electrical charge generated by contact of the load applying member 11 and the sheet P is grounded through the electrical grounding passage from the load applying member 11 to the frame 145 in the above-described order.

The load applying member 11 illustrated in FIG. 22 includes a sheet contact portion 11*a* and a pressing portion 11*b*. The sheet contact portion 11*a* includes a POM resin material having conductive substance. The pressing portion 11*b* includes a metallic weight. By including the sheet contact portion 11*a* and the pressing portion 11*b*, the load applying member 11 has electrical conductivity.

As illustrated in FIG. 23, the load applying member 11 is held by the holder 130*a* included in the housing 130.

In Embodiment 4, electrical charge generated by contact of the load applying member 11 and the sheet P can be electrically grounded through the electrical grounding passage from the load applying member 11. According to this configuration, charging by friction generated between the load applying member 11 and the sheet P can be reduced, and therefore occurrence of abnormal image and multi-feeding caused by biased charges on the surface of the sheet P due to the charging by friction can be restrained.

It is to be noted that the load applying member 11 may include the sheet contact portion 11*a* and the pressing portion 11*b*, both of which are metallic members. However, the load applying member 11 in the present embodiment includes the sheet contact portion 11*a* having a conductive resin material and the pressing portion 11*b* having a metal material. By having different types of materials, the pressing portion 11*b* of metallic material can both apply pressure to the sheet P and conduct electrical grounding and the sheet contact portion 11*a* can maintain a good sliding performance.

Figure 24:
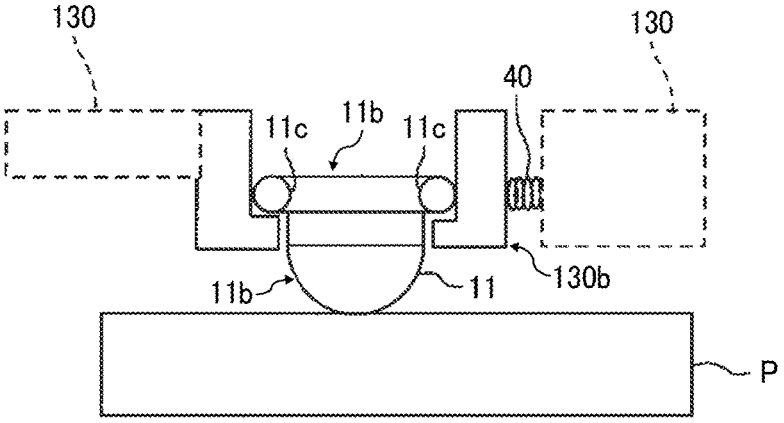
FIG. 24 is a diagram illustrating a case in which the load applying member has a roller mounted on the pressing portion to contact an inner wall face of the holder.

FIG. 24 is a diagram illustrating a case in which the load applying member 11 of FIG. 22 has a roller 11*c* mounted on the pressing portion 11*b* to contact an inner wall face of a holder 130*b* of the housing 130.

As illustrated in FIG. 24, the load applying member 11 of FIG. 22 further includes the roller 11*c* on the pressing portion 11*b*. The roller 11*c* rotatably contacts the inner wall face of the holder 130*b* of the housing 130. With the roller 11*c* rotating along the inner wall face of the holder 130*b*, the load applying member 11 can move smoothly.

One side of the holder 130*b* is variable in position. A pressure spring 40 applies a pressure to the holder 130*b* toward a direction (i.e., a horizontal direction) intersecting a moving direction of the load applying member 11 (i.e., a vertical direction). By so doing, the holder 130*b* contacts the roller 11*c* of the load applying member 11.

Further, both the roller 11*c* and the holder 130*b* include metallic materials. By so doing, an electrical grounding passage is defined by the sheet contact portion 11*a* of the load applying member 11, the pressing portion 11*b* of the load applying member 11, the roller 11*c* of the load applying member 11, the holder 130*b*, the stay 142, the leaf spring 143, the side plate 144, and the frame 145. Electrical charge generated by contact of the load applying member 11 and the sheet P is grounded through the electrical grounding passage from the load applying member 11 to the frame 145 in the above-described order.

According to this configuration, charging by friction generated between the load applying member 11 and the sheet P can be reduced without greatly changing the level of load to the pressure applied by the pressing portion 11*b* of the load applying member 11.

Figure 25:
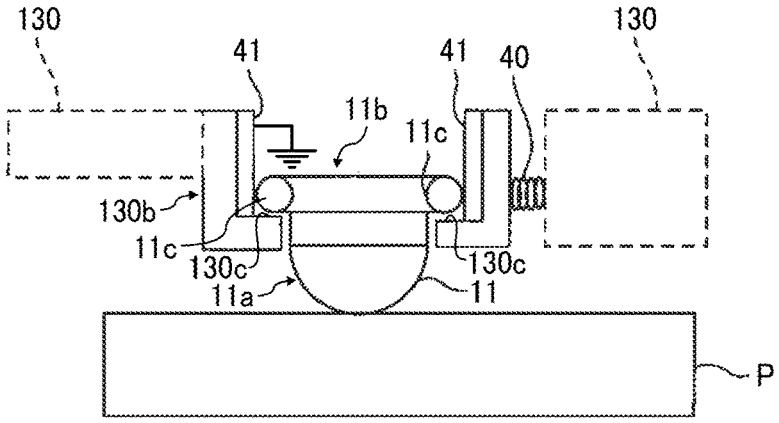
FIG. 25 is a diagram illustrating a configuration having a conductive member extending from a contact portion of the roller of the load applying member and the holder to a stay.

FIG. 25 is a diagram illustrating a configuration having a conductive member extending from a contact portion of the roller 11*c* of the load applying member 11 and a holder 130*c* to the stay 142.

As illustrated in FIG. 25, when the holder 130*b* does not include a conductive member, a conductive member 41 such as a destaticizing cloth and a conductive foil may be attached to (put through) an area from the contact portion of the roller 11*c* of the load applying member 11 and the holder 130*c* to the stay 142. By so doing, an electrical grounding passage is defined by the sheet contact portion 11*a* of the load applying member 11, the pressing portion 11*b* of the load applying member 11, the roller 11*c* of the load applying member 11, the conductive member 41, the stay 142, the leaf spring 143, the side plate 144, and the frame 145. Electrical charge generated by contact of the load applying member 11 and the sheet P is grounded through the electrical grounding passage from the load applying member 11 to the frame 145 in the above-described order.

Figure 26:
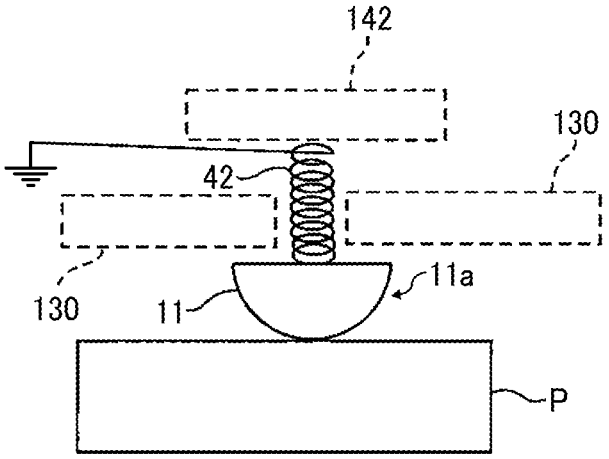
FIG. 26 is a diagram illustrating a configuration in which the pressure spring is used as a pressing member to directly press a sheet contact portion.

FIG. 26 is a diagram illustrating a configuration in which a pressure spring 42 is used as a pressing member to directly press the sheet contact portion 11*a*.

As illustrated in FIG. 26, in a case in which the load applying member 11 does not include the pressing portion 11*b* including a metallic weight that functions as a pressing body to press the load applying member 11 toward the sheet P, a pressure spring 42 may be employed as a pressing body. The pressure spring 42 is a member having conductivity such as a metallic body and directly presses the sheet contact portion 11*a* of the load applying member 11.

In this case, the pressure spring 42 can be employed to an electrical grounding passage. Therefore, the electrical grounding passage in this case is defined by the sheet contact portion 11*a* of the load applying member 11, the pressure spring 42, the stay 142, the leaf spring 143, the side plate 144, and the frame 145. Electrical charge generated by contact of the load applying member 11 and the sheet P is grounded through the electrical grounding passage from the load applying member 11 to the frame 145 in the above-described order.

Embodiment 5

Figure 27:
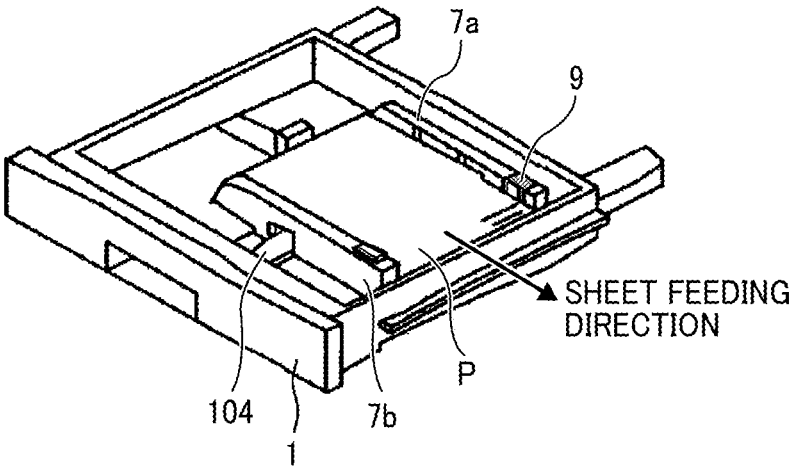
FIG. 27 is a perspective view illustrating the sheet feed tray.
Figure 28:
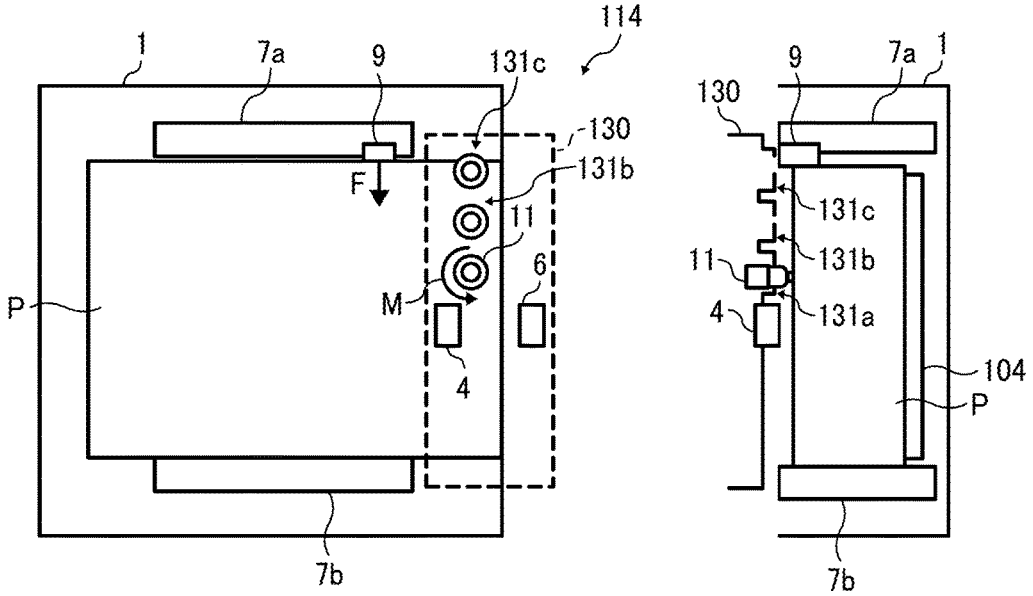
FIG. 28 is a diagram illustrating an example configuration in which a position of the load applying member is changed in a sheet width direction.

FIG. 27 is a perspective view illustrating the sheet feed tray 1 according to Embodiment 5 of this disclosure. FIG. 28 is a diagram illustrating an example configuration in which a position of the load applying member 11 is changed in a sheet width direction.

As illustrated in FIG. 28, the housing 130 of the sheet feeding device 114 includes multiple supporting portions 131*a*, 131*b*, and 131*c* to locate the load applying member 11. The multiple supporting portions 131*a*, 131*b*, and 131*c* are provided such that the position of the load applying member 11 is changed according to a sheet size for a print job to be performed. With this configuration, a sufficient amount of the moment of rotation "M" can be applied to the sheet P with a relatively small weight load. When the sheet P having inappropriate sheet size, sheet thickness, and sheet type is used, inconveniences, such as wrinkles and skews generated by an excess load from the load applying member 11 and non-contact of the sheet P to the side fence 7*b* caused by an insufficient load from the load applying member 11, can occur.

It is to be noted that the housing 130 includes the multiple supporting portions 131*a*, 131*b*, and 131*c* corresponding to respective standard sizes of the sheet P, for example, an A4-size sheet, and therefore respective positions of the multiple supporting portions 131*a*, 131*b*, and 131*c* corresponding to appropriate sheet sizes are clearly indicated to users of the image forming apparatus 100.

Figure 29:
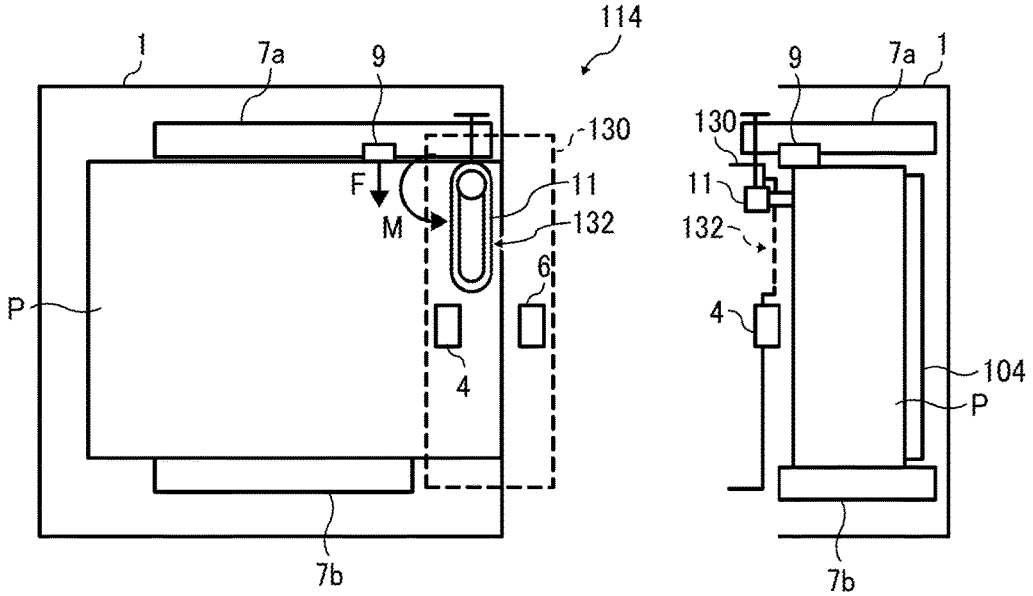
FIG. 29 is a diagram illustrating another example configuration in which the position of the load applying member is changed in the sheet width direction.

FIG. 29 is a diagram illustrating another example configuration in which the position of the load applying member 11 is changed in the sheet width direction. In this configuration, the position of the load applying member 11 in the sheet width direction can be changed automatically.

The configuration in FIG. 29 may be employed to a sheet feeder that can remove the sheet feed tray 1 and the sheet feeding device 114 together as a single unit from the apparatus body of the image forming apparatus 100 or a bypass sheet feeding device including a sheet feeder provided with a sheet loader.

The load applying member 11 is supported by a rail 132 mounted on the housing 130 of the sheet feeding device 114. The load applying member 11 is movable in the sheet width direction along the rail 132. The rail 132 can steplessly switch the position of the load applying member 11 in the sheet width direction. This stepless switching of the position of the load applying member 11 can be applied to both a standard sized sheet P and a non-standard size sheet P. Part of the load applying member 11 is joined to the side fence 7*a*. A joined part of the load applying member 11 and the side fence 7*a* is movable in the sheet loading direction (i.e., the vertical direction) and the load applying member 11 is movable in the upward direction. According to this configuration, as the side fence 7*a* is moved in the sheet width direction, the load applying member 11 is also moved in the sheet width direction. Accordingly, the position of the load applying member 11 in the sheet width direction can be changed to a loading position appropriate to a sheet size of the sheet P automatically.

In addition, a releasing mechanism may be provided to the image forming apparatus 100. Specifically, when the sheet feed tray 1 is pulled out from the apparatus body of the image forming apparatus 100, exceeding a predetermined position, the releasing mechanism releases connection of the side fence 7*a* and the load applying member 11 at the joined part. Therefore, even in another configuration in which the sheet feed tray 1 is removed from the apparatus body of the image forming apparatus 100 while the sheet feeding device 114 remains in the apparatus body, the position of the load applying member 11 in the sheet width direction can be changed to the loading position appropriate to the sheet size of the sheet P automatically.

Embodiment 6

Figure 30:
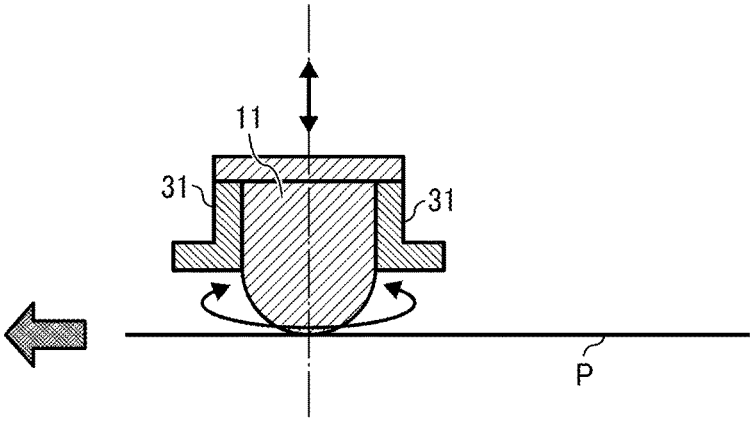
FIG. 30 is a diagram illustrating a state in which a support supports the load applying member in a circumferential direction.
Figure 31:
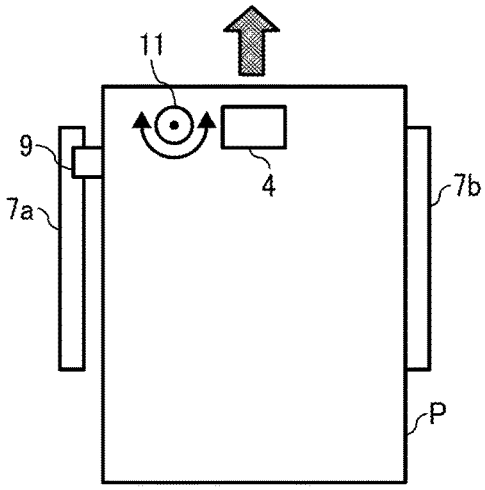
FIG. 31 is a diagram illustrating the sheet feed tray, viewed from above, on which the load applying member is mounted to rotate about an axis.
Figure 32:
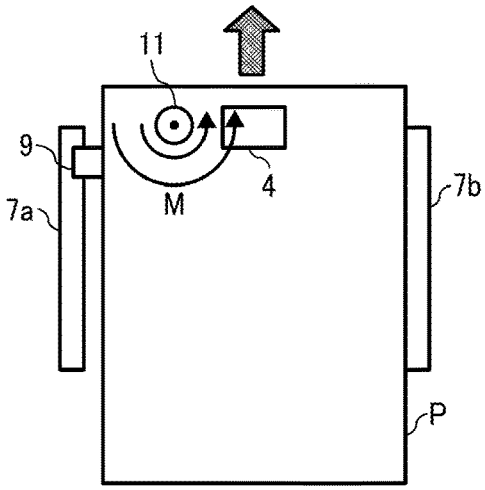
FIG. 32 is a diagram illustrating a state in which the sheet is rotated by a moment of rotation by receiving a load exerted by the load applying member that is rotatable about the axis.

FIG. 30 is a diagram illustrating a state in which a supporting member 31 supports the load applying member 11 in a circumferential direction. FIG. 31 is a diagram illustrating the sheet feed tray 1, viewed from above, on which the load applying member 11 is mounted to rotate about an axis thereof. FIG. 32 is a diagram illustrating a state in which the sheet P is rotated by the moment of rotation "M" by receiving a load exerted by the load applying member 11 that is rotatable about the axis thereof.

In Embodiment 6, as illustrated in FIG. 30, the supporting member 31 supports the load applying member 11 in the circumferential direction of the load applying member 11.

Further, as illustrated in FIG. 30, the load applying member 11 moves in the vertical direction to the surface of the sheet P, as indicated by vertical arrow illustrated in FIG. 30. In addition, as illustrated in FIGS. 30 and 31, the load applying member 11 rotates about a center of rotary axis thereof, as indicated by horizontal arrow illustrated in FIGS.

30 and 31. With this configuration, as illustrated in FIG. 32, when the load applying member 11 applies a load, the sheet P rotates in a direction indicated by arrow in FIG. 32 by the moment of rotation "M" by receiving the load from the load applying member 11. Since the load applying member 11 is rotated with the rotation of the sheet P, a load applied by the load applying member 11 in a direction perpendicular to the sheet feeding direction can be reduced. Accordingly, a sheet shifting performance of the edge of the sheet P in the sheet width direction to the side fence 7*b* can be more accurate. Further, wear of the load applying member 11 caused by friction generated between the load applying member 11 and the sheet P can be reduced, and therefore the service life of the load applying member 11 can be extended.

Figure 33:
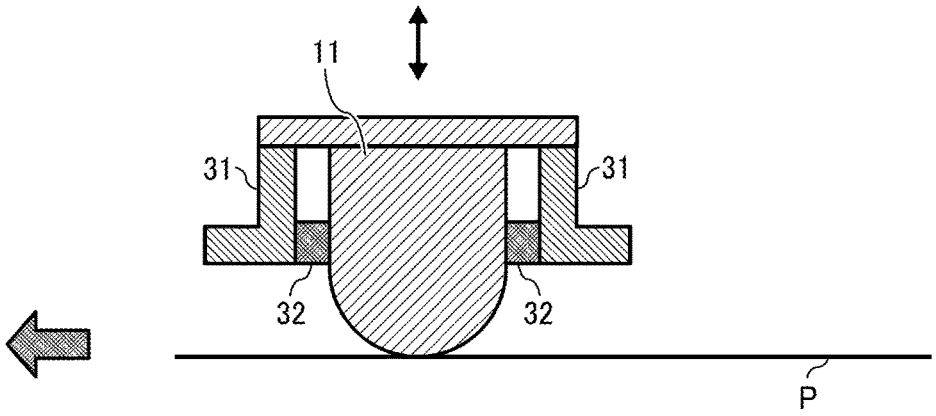
FIG. 33 is a diagram illustrating a state in which the load applying member is press-fitted into a bearing mounted on the support.

Further, FIG. 33 is a diagram illustrating a state in which the load applying member 11 is press-fitted into a bearing 32 mounted on the supporting member 31.

As illustrated in FIG. 33, the bearing 32 is mounted on the supporting member 31 into which the load applying member 11 is pressed. By so doing, the friction between the load applying member 11 and the supporting member 31 in the circumferential direction can be reduced, and therefore wear of the load applying member 11 can be reduced.

Figure 34:
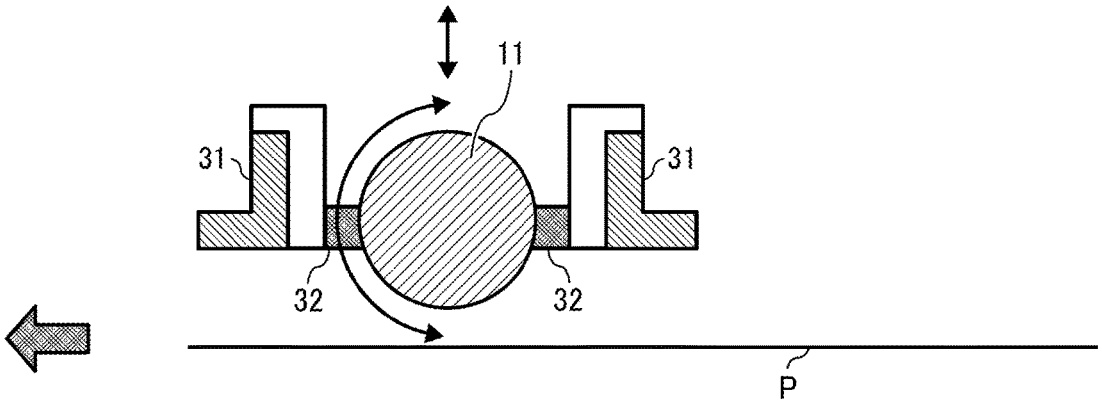
FIG. 34 is a diagram illustrating a state in which the load applying member having a spherical shape is press-fitted into the bearing mounted on the support.

In addition, FIG. 34 is a diagram illustrating a state in which the load applying member 11 having a spherical shape is press-fitted into the bearing 32 mounted on the supporting member 31.

As illustrated in FIG. 34, the load applying member 11 has a spherical shape. Accordingly, the load applying member 11 can rotate in the (vertical) direction that is perpendicular to the surface of the sheet P and the sheet feeding direction (indicated by black arrow), and therefore the sheet shifting performance of the edge of the sheet P in the sheet width direction to the side fence 7*b* can be enhanced. Further, the reduction in level of load in the sheet feeding direction and the direction perpendicular to the sheet feeding direction can reduce wear of the load applying member 11 due to the friction between the load applying member 11 and the sheet P. Accordingly, the durability of the load applying member 11 is enhanced.

The configurations according to the above-descried embodiments are not limited thereto. This disclosure can achieve the following aspects effectively.

Aspect A.

In Aspect A, a sheet feeding device (for example, the sheet feeding device 11) includes a sheet container (for example, the sheet feed tray 1), a sheet feeding body (for example, the sheet pickup roller 4), a pair of sheet position regulators (for example, the pair of sheet fences 7), and a load applier (for example, the load applying member 11). The sheet container is configured to accommodate a recording medium (for example, the sheet P). The sheet feeding body is configured to press a surface of the recording medium in the sheet container and feed the recording medium in a sheet feeding direction. The pair of sheet position regulators includes a first sheet position regulator (for example, the side fence 7*a*) and a second sheet position regulator (for example, the side fence 7*b*) disposed facing each other across the recording medium in the sheet container in a sheet width direction perpendicular to the sheet feeding direction. The pair of sheet position regulators is configured to regulate a position of the recording medium in the sheet width direction. The load applier is disposed between the first sheet position regulator and the sheet feeding body in the sheet width direction and is configured to contact the surface of the recording medium and apply a load to the recording medium at the surface. The recording medium is brought to move toward the second sheet position regulator while the recording medium is being fed.

In Aspect A, the recording medium is being fed toward the second sheet position regulator of the pair of sheet position regulators. Therefore, the recording medium can be fed along the second sheet position regulator. Accordingly, since the recording medium is fed on the basis of the second sheet position regulator as a reference member in the sheet width direction, skew of the recording medium fed from the sheet container can be restrained.

Aspect B.

In Aspect B, a sheet feeding device (for example, the sheet feeding device 11) includes a sheet container (for example, the sheet feed tray 1), a sheet feeding body (for example, the sheet pickup roller 4), a pair of sheet position regulators (for example, the pair of sheet fences 7), and a load applier (for example, the load applying member 11). The sheet container is configured to accommodate a recording medium (for example, the sheet P). The sheet feeding body is configured to press a surface of the recording medium in the sheet container and feed the recording medium in a sheet feeding direction. The pair of sheet position regulators includes a first sheet position regulator (for example, the side fence 7*a*) and a second sheet position regulator (for example, the side fence 7*b*) disposed facing each other across the recording medium in the sheet container in a sheet width direction perpendicular to the sheet feeding direction. The pair of sheet position regulators is configured to regulate a position of the recording medium in the sheet width direction. The load applier is disposed between the first sheet position regulator and the sheet feeding body in the sheet width direction and is configured to contact the surface of the recording medium and apply a load to the recording medium at the surface. A lower face position in a standby state of the sheet feeding body is lower than a lower face position in a standby state of the load applier.

According to this configuration, as described in the above-described embodiments, the load applier can be pressed reliably to an uppermost recording medium placed on top of a sheet bundle accommodated in the sheet container.

Aspect C.

In Aspect A or Aspect B, the sheet feeding device (for example, the sheet feeding device 114) further includes a pressing body (for example, the pressing member 9) and a width position regulator (for example, the regulating member 15). The pressing body is mounted on the first sheet position regulator and is configured to press the recording medium in the sheet container to the second sheet position regulator. The width position regulator is mounted on the second sheet position regulator and is configured to regulate the position of the recording medium in the sheet width direction while holding the recording medium together with the pressing body.

According to this configuration, as described in the above-described embodiments, the side edge of the recording medium in the sheet width direction can be aligned along the second sheet position regulator highly accurately.

Aspect D.

In Aspect C, the pressing body and the width position regulator are disposed downstream from the sheet container in the sheet feeding direction and at an approximately same position.

According to this configuration, as described in the above-described embodiments, calculation of moments can be performed easily. In addition, variation in the position of the edge of the recording medium in the sheet width direction can be reduced due to the rotation.

Aspect E.

In any one of Aspect A through Aspect D, the load applier is located at a specified position in the sheet width direction and a level of load applied to the recording medium by the load applier is changeable.

According to this configuration, as described in the above-described embodiments, inconveniences such as occurrence of no sheet feeding, generation of wrinkles, and non-contact of the recording medium to the second sheet position regulator can be reduced.

Aspect F.

In Aspect E, the sheet feeding device further includes a biasing body (for example, the compression spring 24) configured to bias the load applier toward the recording medium. A height of compression of the biasing body is changeable.

According to this configuration, as described in the above-described embodiments, a space-saving effect can be achieved, and the level of load applied by the load applier to the recording medium can be changed by changing the height of compression of the biasing body.

Aspect G.

In Aspect E, the sheet feeding device further includes a weight (for example, the weight 26) configured to weight the recording medium by the load applier. The weight includes multiple weights and the number of the multiple weights can be changed.

According to this configuration, as described in the above-described embodiments, a space-saving effect can be achieved, and the level of load applied by the load applier to the recording medium can be changed.

Aspect H.

In any one of Aspect A through Aspect D, the sheet feeding device further includes a load releaser (for example, the pickup arm 12 and the pickup arm link member 16) configured to release the load to the recording medium by the load applier.

According to this configuration, as described in the above-described embodiments, occurrence of wrinkles and gloss streaks in the recording medium can be restrained.

Aspect I.

In Aspect H, the sheet feeding device further includes a support (for example, the pickup arm 12) configured to support and move the sheet feeding body between a lowered position at which the sheet feeding body contacts the recording medium and a lifted position at which the sheet feeding body separates from the recording medium. The load applier and the support are engaged with each other when the support moves from the lowered position to the lifted position, and the load applier and the support are disengaged from each other when the support moves from the lifted position to the lowered position.

According to this configuration, as described in the above-described embodiments, a load applied by the load applier and the moment of rotation to the recording medium for a relatively long period of time during sheet conveyance can be restrained.

Aspect J.

In any one of Aspect A through Aspect D, at least a part of the load applier includes a conductive body.

According to this configuration, as described in the above-described embodiments, charging by friction generated between the load applier and the recording medium can be reduced, and therefore occurrence of abnormal image and multi-feeding caused by biased charges on the surface of the recording medium due to the charging by friction can be restrained.

Aspect K.

In Aspect J, the load applier includes a sheet contact portion (for example, the sheet contact portion 11*a*) and a pressing portion (for example, the sheet pressing portion 11*b*). The sheet contact portion is configured to contact the recording medium. The sheet pressing portion is configured to press the sheet contact portion to the recording medium.

According to this configuration, as described in the above-described embodiments, both the sheet contact portion and the sheet pressing portion can select respective materials appropriate to respective functions.

Aspect L.

In Aspect K, the sheet pressing portion includes a conductive body.

According to this configuration, as described in the above-described embodiments, the conductive body does not directly contact the recording medium. Therefore, the load applier can be electrically grounded without worrying about wear caused by the recording medium.

Aspect M.

In Aspect J, the sheet feeding device further includes a grounding body (for example, the holder 130*b*) configured to contact the load applier in a direction perpendicular to a moving direction of the load applier.

According to this configuration, as described in the above-described embodiments, charging by friction generated between the load applier and the recording medium can be reduced without greatly changing the level of load to the pressure applied by the sheet pressing portion of the load applier.

Aspect N.

In any one of Aspect A through Aspect D, an amount of rotational moment applied by the load applier to the recording medium is changeable.

According to this configuration, as described in the above-described embodiments, inconveniences, for example, occurrence of wrinkles and skews generated by an excess load from the load applier and non-contact of the recording medium to the second sheet position regulator caused by an insufficient load from the load applier, can be restrained.

Aspect O.

In Aspect N, a position of the load applier in the sheet width direction in the sheet container is changeable.

According to this configuration, as described in the above-described embodiments, the position of the load applier can be changed and located to the loading position appropriate to the sheet size of the recording medium.

Aspect P.

In Aspect O, the position of the load applier is changeable in conjunction with the position of at least one of the pair of sheet position regulators.

According to this configuration, as described in the above-described embodiments, as the at least one of the pair of sheet position regulators moves in the sheet width direction, the load applier moves in the sheet width direction together with the at least one of the pair of sheet position regulators. Therefore, the position of the load applier in the sheet width direction can be changed to a loading position appropriate to a sheet size of the recording medium automatically.

Aspect Q.

In any one of Aspect A through Aspect D, the sheet feeding device further includes a support body (for example, the support 31) configured to rotatably support the load applier in at least one direction.

According to this configuration, as described in the above-described embodiments, a sheet shifting performance of the edge of the recording medium in the sheet width direction to the second sheet position regulator can be more accurate. Further, wear of the load applier caused by friction generated between the load applier and the recording medium can be reduced, and therefore the service life of the load applier can be extended.

Aspect R.

In Aspect Q, the support body supports the load applier such that the load applier rotates axially within a horizontal plane parallel to the surface of the recording medium accommodated in the sheet container.

According to this configuration, as described in the above-described embodiments, a load applied by the load applier in a direction perpendicular to the sheet feeding direction can be reduced, and therefore the sheet shift performance of the edge of the recording medium in the sheet width direction to the second sheet position regulator can be enhanced.

Aspect S.

In Aspect R, the support body supports the load applier such that the load applier rotates axially within a horizontal plane parallel to the sheet feeding body in the sheet feeding direction.

According to this configuration, as described in the above-described embodiments, wear of the load applier due to the friction between the load applier and the recording medium is reduced, and therefore the durability of the load applier is enhanced.

Aspect T.

In Aspect T, an image forming apparatus (for example, the image forming apparatus 100) includes an image forming device (for example, the image forming units 101Y, 101M, 101C, and 101K) configured to form an image on a recording medium (for example, the sheet P), and the sheet feeding device (for example, the sheet feeding device 114) according to any one of Aspect A through Aspect S to feed the recording medium contained in the sheet container toward the image forming device.

According to this configuration, as described in the above-described embodiments, skew of the recording medium can be restrained and a good image forming operation can be performed.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet feeding device comprising:

a sheet container configured to accommodate a recording medium;

a sheet feeding body configured to press a surface of the recording medium in the sheet container and feed the recording medium in a sheet conveying direction;

a pair of sheet position regulators including a first sheet position regulator and a second sheet position regulator facing each other across the recording medium in the sheet container in a sheet width direction perpendicular to the sheet conveying direction, the pair of sheet position regulators configured to regulate a position of the recording medium in the sheet width direction;

a load applier between the first sheet position regulator and the sheet feeding body in the sheet width direction, the load applier configured to contact the surface of the recording medium and apply a body weight of the load applier as a load to the recording medium at the surface; and a load releaser configured to release the load to the recording medium by the load applier.

2. The sheet feeding device of claim 1, wherein a lower face position in a standby state of the load applier is lower than a lower face position in a standby state of the sheet feeding body.

3. An image forming apparatus comprising:

an image forming device configured to form an image on a recording medium; and the sheet feeding device according to claim 2, configured to feed the recording medium contained in the sheet container toward the image forming device.

4. The sheet feeding device according to claim 1, further comprising:

a pressing body mounted on the first sheet position regulator and configured to press the recording medium in the sheet container to the second sheet position regulator; and a width position regulator mounted on the second sheet position regulator and configured to regulate the position of the recording medium in the sheet width direction while holding the recording medium together with the pressing body.

5. The sheet feeding device according to claim 4, wherein the pressing body and the width position regulator are downstream from the sheet container in a sheet feeding direction and at an approximately same position.

6. The sheet feeding device according to claim 1, wherein the load applier is located at a specified position in the sheet width direction, and wherein a level of load applied to the recording medium by the load applier is changeable.

7. The sheet feeding device according to claim 6, further comprising a weight configured to weight the recording medium by the load applier, wherein the weight includes multiple weights, and wherein a quantity of the multiple weights is changeable.

8. The sheet feeding device according to claim 1, further comprising a support configured to support and move the sheet feeding body between a lowered position at which the sheet feeding body contacts the recording medium and a lifted position at which the sheet feeding body separates from the recording medium, wherein the load applier and the support are engaged with each other when the support moves from the lowered position to the lifted position, and the load applier and the support are disengaged from each other when the support moves from the lifted position to the lowered position.

9. The sheet feeding device according to claim 1, wherein an amount of rotational moment applied by the load applier to the recording medium is changeable.

10. The sheet feeding device according to claim 9, wherein a position of the load applier in the sheet width direction in the sheet container is changeable.

11. The sheet feeding device according to claim 10, wherein the position of the load applier is changeable in conjunction with a position of at least one of the pair of sheet position regulators.

12. The sheet feeding device according to claim 1, further comprising a support body configured to rotatably support the load applier in at least one direction.

13. The sheet feeding device according to claim 12, wherein the support body supports the load applier such that the load applier rotates axially.

14. An image forming apparatus comprising:

an image forming device configured to form an image on a recording medium; and the sheet feeding device according to claim 1, configured to feed the recording medium contained in the sheet container toward the image forming device.

15. A sheet feeding device, comprising:

a sheet container configured to accommodate a recording medium;

a sheet feeding body configured to press a surface of the recording medium in the sheet container and feed the recording medium in a sheet conveying direction;

a pair of sheet position regulators including a first sheet position regulator and a second sheet position regulator facing each other across the recording medium in the sheet container in a sheet width direction perpendicular to the sheet conveying direction, the pair of sheet position regulators configured to regulate a position of the recording medium in the sheet width direction; and a load applier between the first sheet position regulator and the sheet feeding body in the sheet width direction, the load applier configured to contact the surface of the recording medium and apply a body weight of the load applier as a load to the recording medium at the surface, wherein at least a part of the load applier includes a conductive body.

16. The sheet feeding device according to claim 15, wherein the load applier includes a sheet contact portion configured to contact the recording medium, and a sheet pressing portion configured to press the sheet contact portion to the recording medium.

17. The sheet feeding device according to claim 16, wherein the sheet pressing portion includes a conductive body.

18. The sheet feeding device according to claim 15, further comprising a grounding body configured to contact the load applier in a direction perpendicular to a moving direction of the load applier.

19. A sheet feeding device, comprising:

a sheet container configured to accommodate a recording medium;

a sheet feeding body configured to press a surface of the recording medium in the sheet container and feed the recording medium in a sheet conveying direction;

a pair of sheet position regulators including a first sheet position regulator and a second sheet position regulator facing each other across the recording medium in the sheet container in a sheet width direction perpendicular to the sheet conveying direction, the pair of sheet position regulators configured to regulate a position of the recording medium in the sheet width direction; and a load applier between the first sheet position regulator and the sheet feeding body in the sheet width direction, the load applier configured to contact the surface of the recording medium and apply a body weight of the load applier as a load to the recording medium at the surface, wherein the load applier is rotatable about an axis thereof extending in a vertical direction, relative to the surface of the recording medium.

* * * * *